US008658928B2

(12) United States Patent
Takayuki et al.

(10) Patent No.: US 8,658,928 B2
(45) Date of Patent: Feb. 25, 2014

(54) SWITCH

(75) Inventors: Abe Takayuki, Kurayoshi (JP); Kenichi Ando, Okayama (JP); Shigenobu Kishi, Ritto (JP); Yuya Kudo, Kurayoshi (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 221 days.

(21) Appl. No.: 13/173,665

(22) Filed: Jun. 30, 2011

(65) Prior Publication Data

US 2012/0000754 A1 Jan. 5, 2012

(30) Foreign Application Priority Data

Jul. 5, 2010 (JP) ..... 2010-153033
Feb. 8, 2011 (JP) ..... 2011-024625

(51) Int. Cl.
*H01H 5/06* (2006.01)

(52) U.S. Cl.
USPC ..... 200/462; 200/288

(58) Field of Classification Search
USPC ..... 200/462, 288, 405, 467
See application file for complete search history.

(56) References Cited

U.S. PATENT DOCUMENTS 4,673,778 A 6/1987 Lewandowski et al.
6,717,084 B1 * 4/2004 Lu ..... 200/462
8,178,807 B2 * 5/2012 Aichele et al. ..... 200/462
2009/0272637 A1 11/2009 Aichele et al.

FOREIGN PATENT DOCUMENTS

JP 10-297364 A 11/1998

OTHER PUBLICATIONS

Extended European Search Report Issued in European Application No. 11169774.4, Dated Oct. 24, 2011 (5 Pages).
Office Action Issued in Chinese Application No. 201110179452.7, Dated: Jul. 18, 2013 (11 Pages With English Translation).

* cited by examiner

*Primary Examiner* — Felix O Figueroa
(74) *Attorney, Agent, or Firm* — Osha Liang LLP

(57) ABSTRACT

A switch has a housing, a contact mechanism having a movable contact piece disposed in the housing, an operating element that operates the movable contact piece, a spring member of the contact mechanism that operates the movable contact piece to open and close a contact, and a regulating mechanism that suppresses vibration of the spring member arranged at a position contacting the spring member.

6 Claims, 34 Drawing Sheets

SWITCH

BACKGROUND OF THE INVENTION

1. Technical Field

The present invention relates to switches, and in particular, to a micro-switch capable of inhibiting the occurrence of resonance phenomenon and preventing false operation.

2. Related Art

Conventionally, the switch may be a brake lever interlocking switch including a switch case, a swing plate attached to the switch case to swing interlocking with the brake lever, a plurality of push rods that is attached to the switch case to push down with the swing plate and that has different distances from the center of rotation of the swing plate, and a switch means facing such push rods (see Japanese Unexamined Patent Publication No. 10-297364)

SUMMARY

In the above-described switch, however, the amplitude of a spring 99 or a spring member increases by the vibration generated when opening and closing the contact or the impact force applied from the outside, and the resonance phenomenon tends to easily occur, as shown in FIG. 8 thereof. When the resonance phenomenon occurs, not only does false operation occur, but the spring member easily breaks, the contact wears, and the contact lifespan becomes short.

One or more embodiments of the present invention provides a switch capable of inhibiting the occurrence of the resonance phenomenon caused by the increase of the amplitude of the spring member and preventing false operation, and furthermore, preventing the breakage of the spring member and realizing long contact lifespan.

In accordance with one or more embodiments of the present invention, there is provided a switch in which a movable contact piece of a contact mechanism arranged in a housing is operated with an operating element, and the movable contact piece is operated with a spring member of the contact mechanism to open and close a contact; wherein a regulating means for suppressing vibration of the spring member is arranged at a position of contacting the spring member. Especially, the regulating means may be arranged to be brought into contact with the spring member at time of resonance.

According to one or more embodiments of the present invention, when the contact mechanism is operated with the operating element or when the impact force is applied from the outside, the spring member is not brought into contact with the regulating means if the spring member is not vibrating, whereas the spring member is brought into contact with the regulating means if the spring member is vibrating, particularly, if the spring member starts to vibrate. As a result, the regulating means shifts the timing to increase the amplitude of the spring member so that the amplitude of the spring member does not increase and the resonance phenomenon can be inhibited. Therefore, the false operation can be prevented, and furthermore, the breakage of the spring member can be prevented and the wear of the contact can be reduced so that a switch of longer contact lifespan can be realized.

In one or more embodiments of the present invention, the spring member may be a coil member.

Accordingly, a switch having a large degree of freedom of design can be realized since the elastic displacement amount of the coil spring is large.

In one or more embodiments of the present invention, the spring member may be a plate spring integral with the movable contact piece.

Accordingly, a switch with less number of components and number of assembly steps and with high productivity can be obtained.

In one or more embodiments of the present invention, the spring member may be a plate spring of a separate body from the movable contact piece.

Accordingly, a switch having a large degree of freedom of design can be realized by using the plate spring of a separate body.

In one or more embodiments of the present invention, the regulating means may be a tongue piece cutout from a terminal of the contact mechanism.

Accordingly, a switch with less number of components and number of assembly steps and with high productivity can be obtained.

In one or more embodiments of the present invention, the regulating means may be a projection arranged in a projecting manner on the inner surface of the housing or a bulging portion bulging out from the inner surface of the housing.

Accordingly, a switch with high productivity can be obtained by integrally molding the regulating means at the same time as the housing.

The projection or the bulging portion may be assembled after being molded separate from the housing rather than being integrally molded on the inner surface of the housing.

DETAILED DESCRIPTION

Figure 1A:
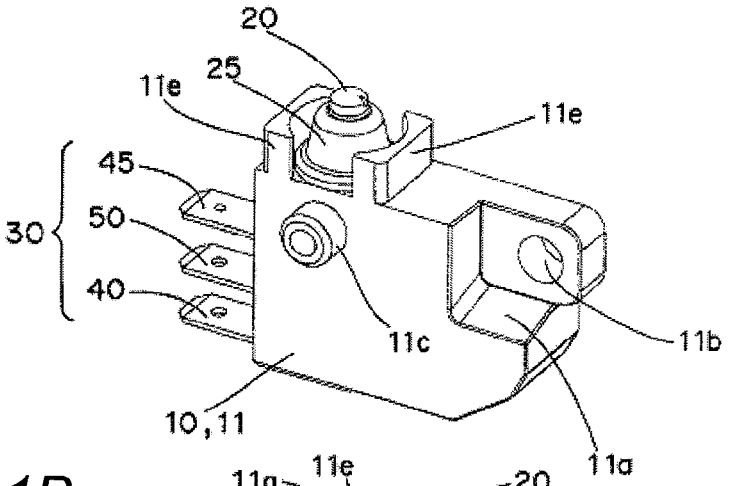
FIGS. 1A, 1B, and 1C are perspective views showing a switch according to a first embodiment of the present invention.

Hereinafter, embodiments of the present invention will be described with reference to the accompanied drawings FIGS. 1A to 1C to FIGS. 32A to 32C. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

As shown in the accompanied drawings FIGS. 1A to 1C to FIGS. 8A to 8C, a switch according to a first embodiment is configured by a housing 10, an operating element 20 attached to the housing 10 through a rubber cap 25, and a contact mechanism 30 assembled to a holder 31 incorporated in the housing 10 from the side and operated by the operating element 20.

Figure 1B:
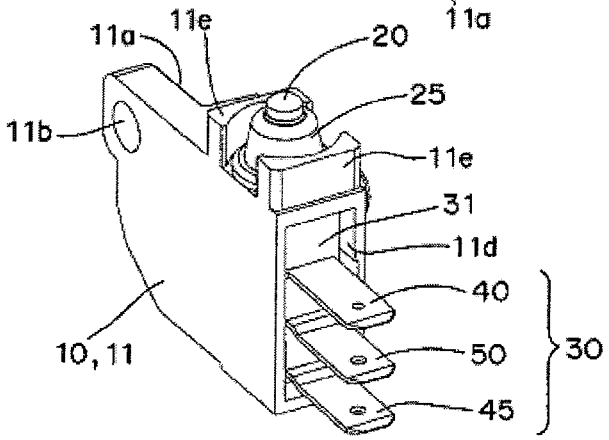
Figure 1C:
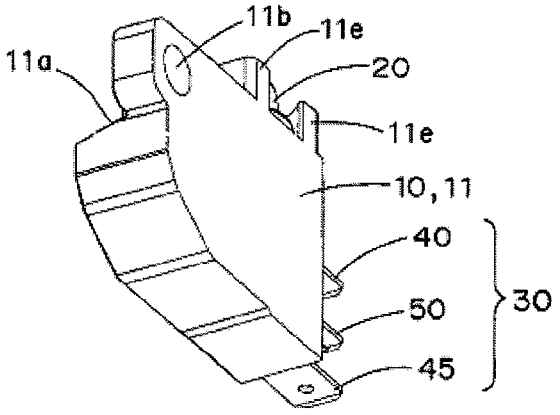

As shown in FIG. 1A, the housing 10 includes an attachment hole 11*b* at a side surface of a step portion 11*a* arranged on one side of a one side surface of a housing main body 11, and has a positioning boss 11*c* arranged in a projecting manner on the other side. As shown in FIG. 1B, the housing main body 11 includes a vertically long assembly opening 11*d* at the end face on the other side. Furthermore, the housing main body 11 has an operation hole 11*f* arranged between a pair of protection barriers 11*e*, 11*e* arranged in a projecting manner to the other side of the upper end face (FIG. 2).

Figure 2:
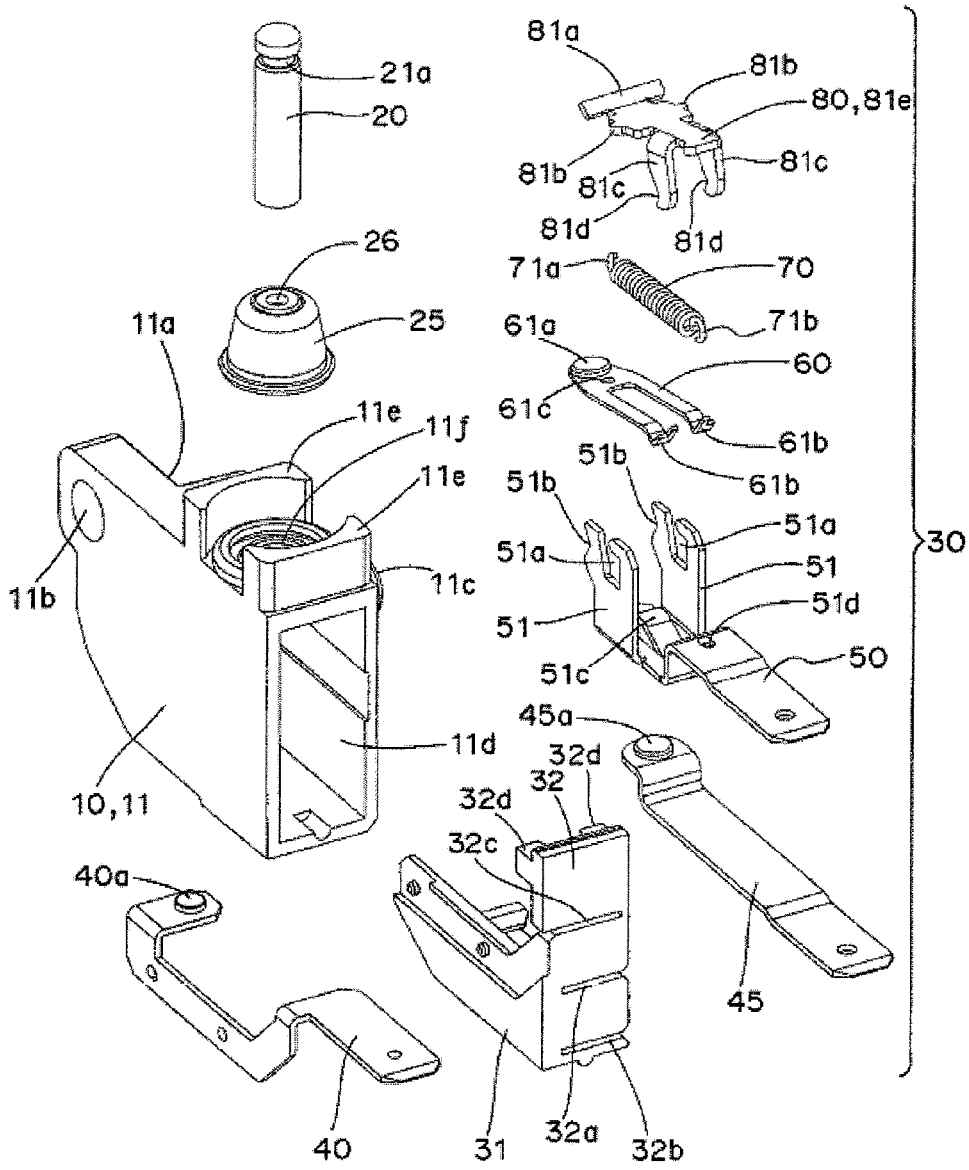
FIG. 2 is an exploded perspective view of the switch shown in FIG. 1B.
Figure 3:
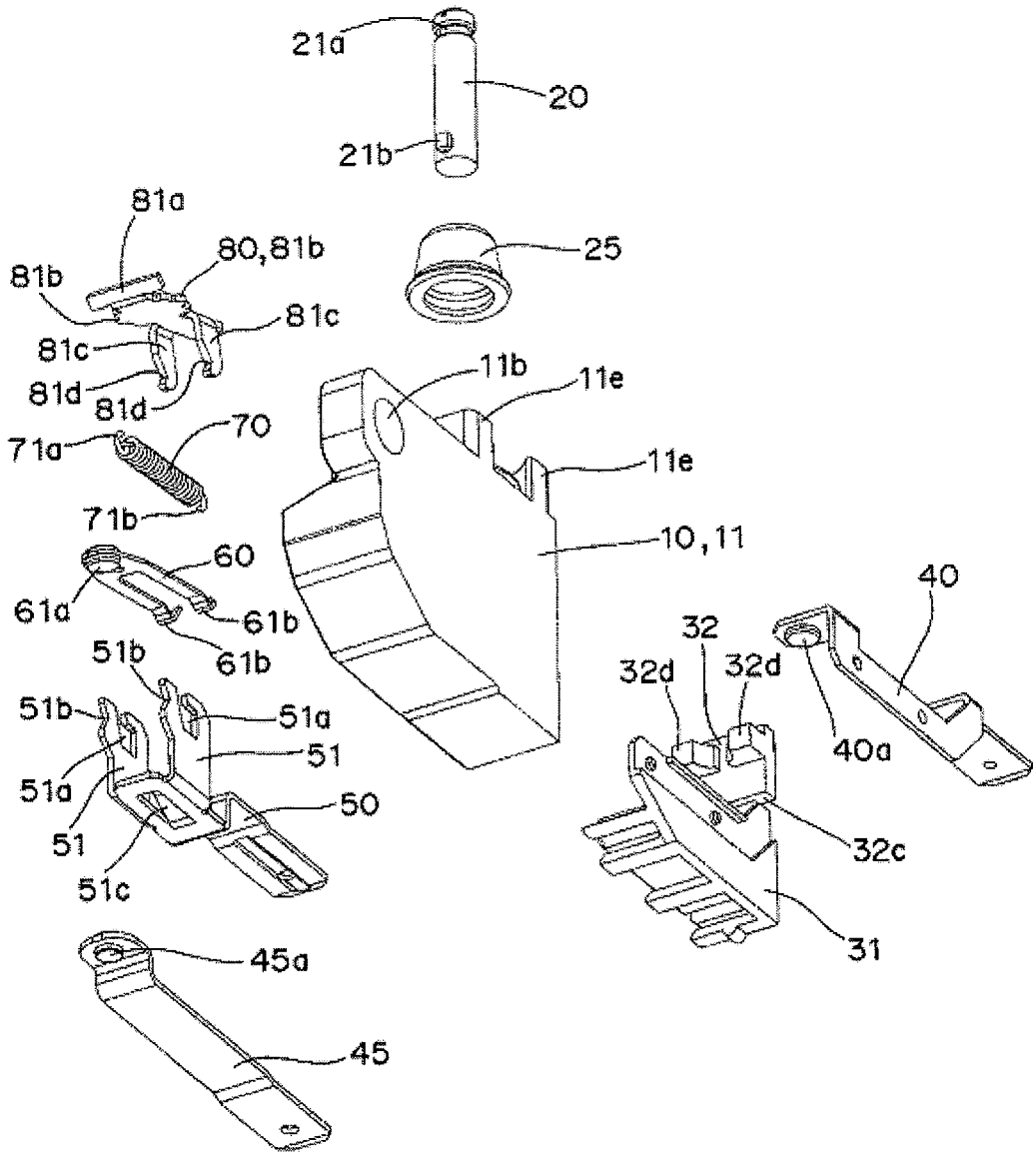
FIG. 3 is an exploded perspective view of the switch shown in FIG. 1C.

As shown in FIG. 2, the operating element 20 is assembled to the operation hole 11*f* of the housing 10 so as to be movable up and down by fitting an annular edge of an opening 26 of the rubber cap 25 to an annular groove 21*a* formed on the upper side. A slip-out preventing projection 21*b* is projected to the side at the outer peripheral surface on the lower side of the operating element 20 (FIG. 3).

As shown in FIG. 2, the contact mechanism 30 has a common terminal 50 arranged between an always-opened fixed contact terminal 40 and an always-closed fixed contact terminal 45 assembled to the holder 31. An always-opened fixed contact 40*a* and an always-closed fixed contact 45*a* are respectively arranged at one end of the always-opened fixed contact terminal 40 and the always-closed fixed contact terminal 45. A movable contact piece 60, a coil spring 70 serving as a spring member, and an operation piece 80 are assembled to the common terminal 50.

The holder 31 has an outer peripheral shape that can be inserted from an assembly opening 11*d* of the housing 10, and has press-fit slits 32*a*, 32*b*, 32*c* alternately arranged in a zigzag manner on a vertical wall 32. A pair of guide projections 32*d*, 32*d* is arranged on an inward surface of the vertical wall 32 to position regulate the operating element 20, to be described later.

The common terminal 50 has a pair of raised pieces 51, 51 formed by cutting and raising both side edges on one side. The raised piece 51 has a cutout 51*a* formed at the upper end and has a lock receiving portion 51*b* formed at the outward edge of the raised piece 51. The common terminal 50 has a tongue piece 51*c* cut and raised between the raised pieces 51. Furthermore, the common terminal 50 includes a lock hole 51*d* in the vicinity of the tongue piece 51*c*.

The tongue piece 51*c* prevents resonance of the coil spring 70 by bringing a bent portion formed by bending the distal end edge to the lower side into contact with the lower surface of the coil spring 70 to be described later. The bent portion may have a shape that not only point contacts the coil spring 70, but also line contacts or area contacts thereto. In particular, if configured to line contact or area contact, the coil spring 70 can be reliably brought into contact with the bent portion even if the dimensional accuracy and the assembly accuracy of the components vary, so that the amplification of the amplitude of the coil spring 70 can be more reliably prevented.

The movable contact piece 60 is a conductive plate spring having a substantially U-shape, where a movable contact 61*a* is arranged at one end and a lock portion 61*b* that becomes a supporting point of turn is formed at both ends on the other end side. The movable contact piece 60 also includes a lock hole 61*c* in the vicinity of the movable contact 61*a*.

The coil spring 70 has one end 71*a* lockable to the lock hole 61*c* of the movable contact piece 60 and the other end 71*b* lockable to the lock hole 51*d* of the common terminal 50.

The operation piece 80 has an engagement shaft portion 81*a* formed along the edge on one side, and a slip-out preventing projection 81*b* that engages the cutout 51*a* of the raised piece 51 arranged to project to the side at both side edges of the intermediate portion. The operation piece 80 has a lock receiving portion 81*d* arranged at a distal end of an arm portion 81*c* bent down from both side edges on the other side, and has the other end serving as an operation receiving portion 81*e*.

The assembly method of the switch according to the first embodiment will now be described.

Figure 4A:
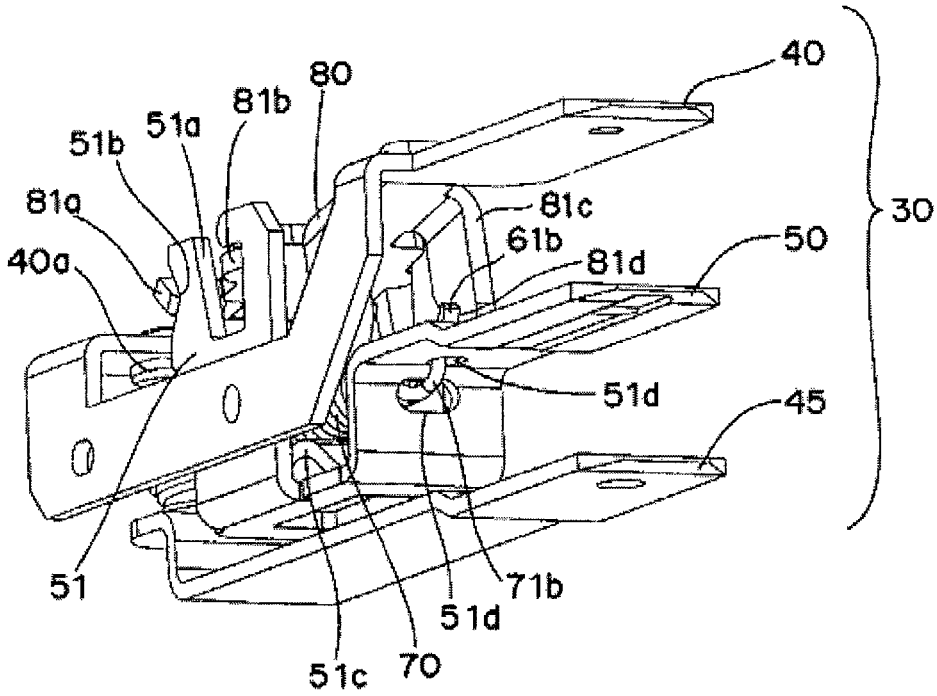
FIGS. 4A and 4B are perspective views showing a contact mechanism of the switch shown in FIGS. 1A to 1C.
Figure 4B:
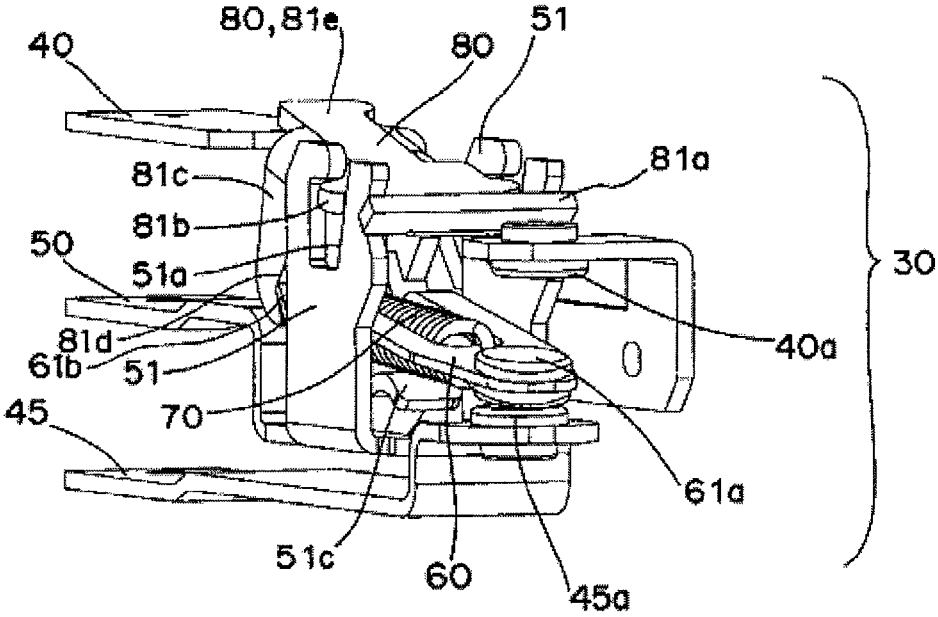

First, the one end 71*a* of the coil spring 70 shown in FIG. 2 is locked to the lock hole 61*c* of the movable contact piece 60, and the other end 71*b* is locked to the lock hole 51*d* of the common terminal 50. As shown in FIG. 4A and FIG. 4B, the slip-out preventing projection 81*b* of the operation piece 80 is engaged to the cutout 51*a* of the common terminal 50, and thereafter the engagement shaft portion 81*a* of the operation piece 80 is engaged to the lock receiving portion 51*b* of the common terminal 50 and the lock portion 61*b* of the movable contact piece 60 is locked to lock receiving portion 81*d* formed in the arm portion 81*c*. The movable contact piece 60 is thereby biased towards the lower side by the spring force of the coil spring 70.

Furthermore, the common terminal 50 shown in FIG. 2 is press fit and positioned in the slit 32*a* of the holder 31, and the always-closed fixed contact terminal 45, the always-opened fixed contact terminal 40 are press fit to the slits 32*b*, 32*c*, respectively. The movable contact 61*a* faces the always-closed fixed contact 45*a* and the always-opened fixed contact 40*a* so as to approach or separate thereto.

After inserting the holder 31 from the opening 11*d* of the housing 10, it is shielded with a resin mold. The opening edge on the lower side of the rubber cap 25 is fitted and thermally caulked to the opening edge of the operation hole 11*f* of the housing 10, and then the operating element 20 is press fit from the opening 26 of the rubber cap 25 and the opening edge of the rubber cap 25 is elastically fitted and sealed to the annular groove 21*a* of the operating element 20.

The operation method of the switch will now be described.

Figure 5A:
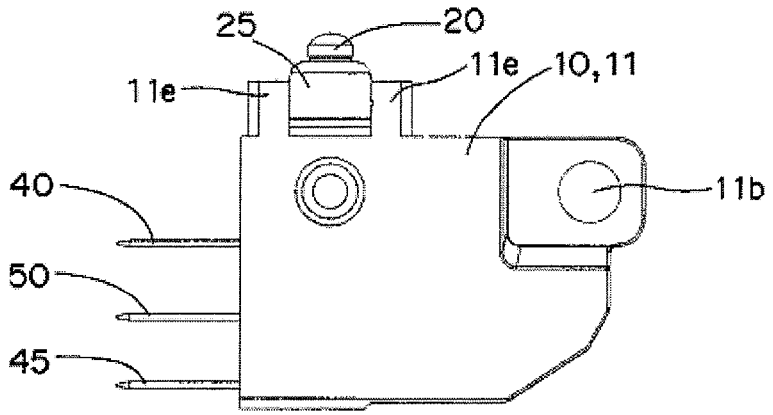
FIGS. 5A, 5B, and 5C are a front view describing the operation process, a cross-sectional view cut at a position of removing only the side wall on the front surface side of the housing, and a cross-sectional view cut at a position of vertically dividing the operating element in half.
Figure 5B:
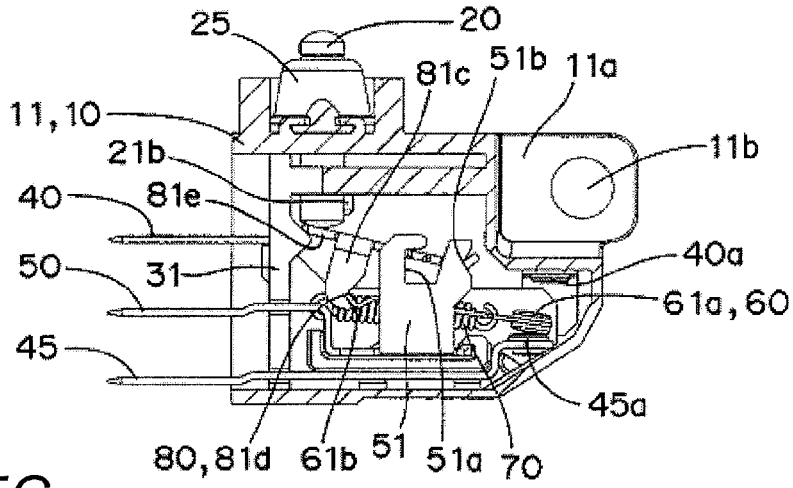
Figure 5C:
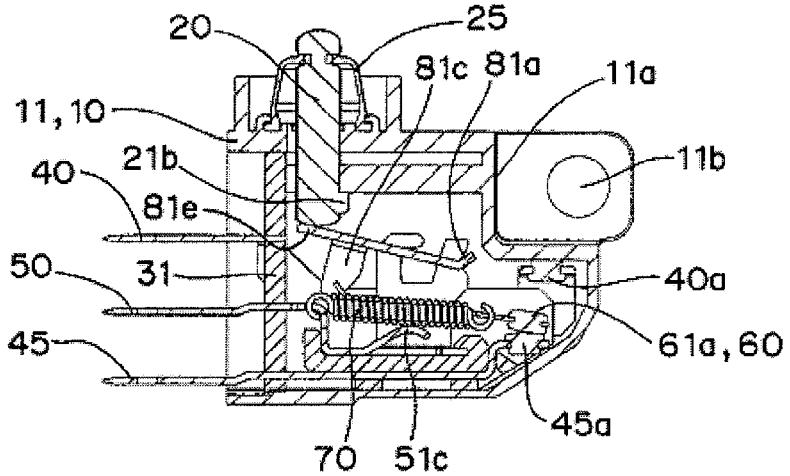

First, as shown in FIGS. 5A to 5C, the operation receiving portion 81*e* of the operation piece 80 is biased to the upper side by the spring force of the coil spring 70 and the operating element 20 is also biased to the upper side in the no-load state. However, the operating element 20 does not slip out since the slip-out preventing projection 21*b* is locked to the top surface of the housing 10. The movable contact 61*a* is brought into contact with the always-closed fixed contact 45*a* and separated from the always-opened fixed contact 40*a*.

Figure 6A:
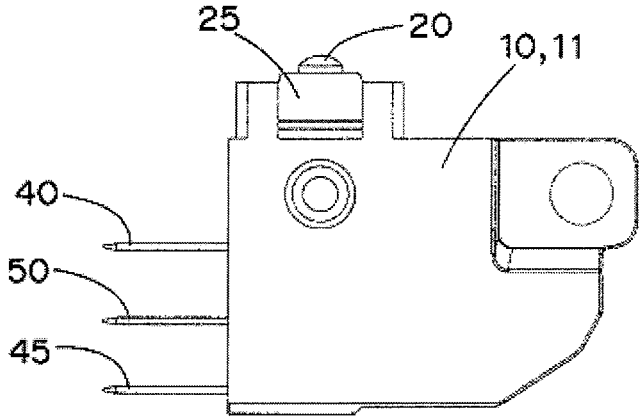
FIGS. 6A, 6B, and 6C are a front view describing the operation process, a cross-sectional view cut at a position of removing only the side wall on the front surface side of the housing, and a cross-sectional view cut at a position of vertically dividing the operating element in half.
Figure 6B:
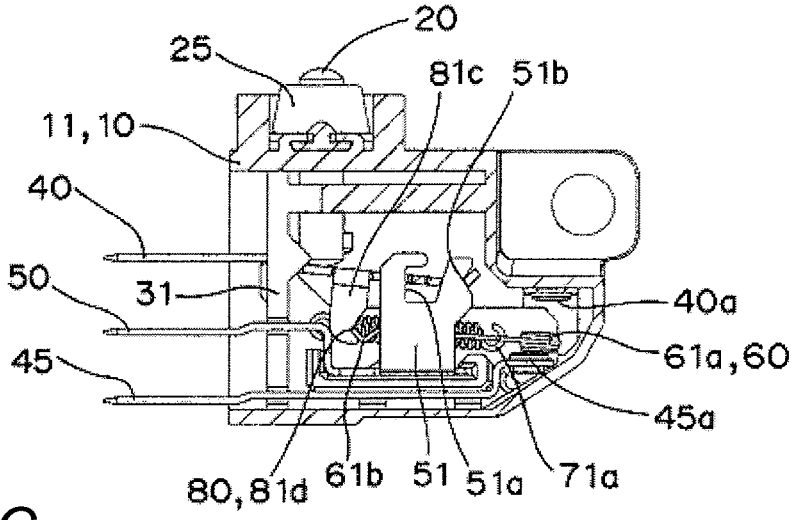
Figure 6C:
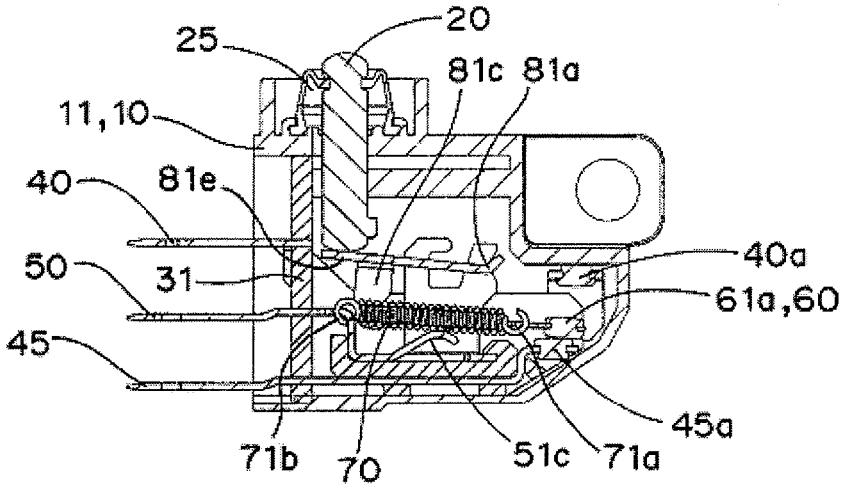
Figure 7A:
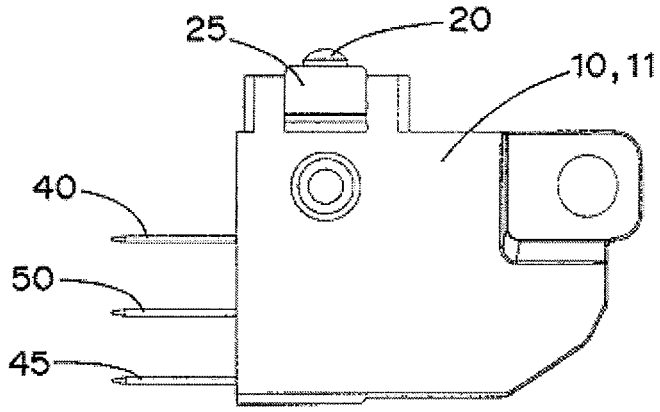
FIGS. 7A, 7B, and 7C are a front view describing the operation process, a cross-sectional view cut at a position of removing only the side wall on the front surface side of the housing, and a cross-sectional view cut at a position of vertically dividing the operating element in half.
Figure 7B:
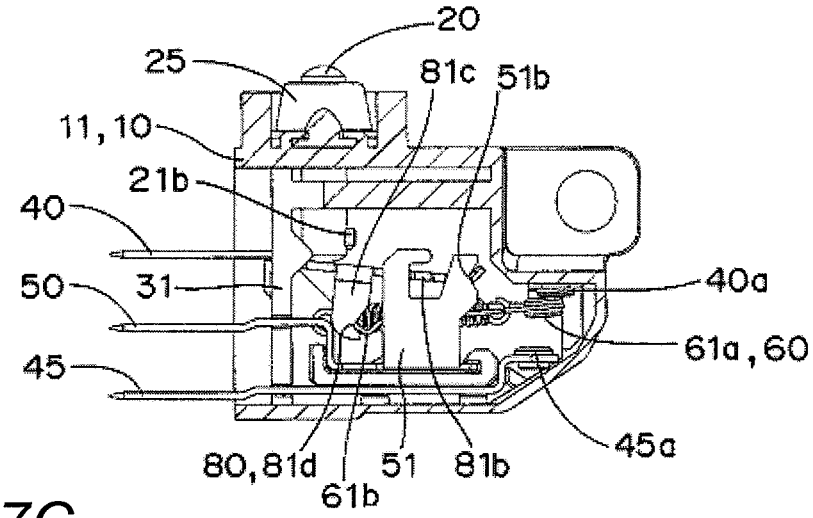
Figure 7C:
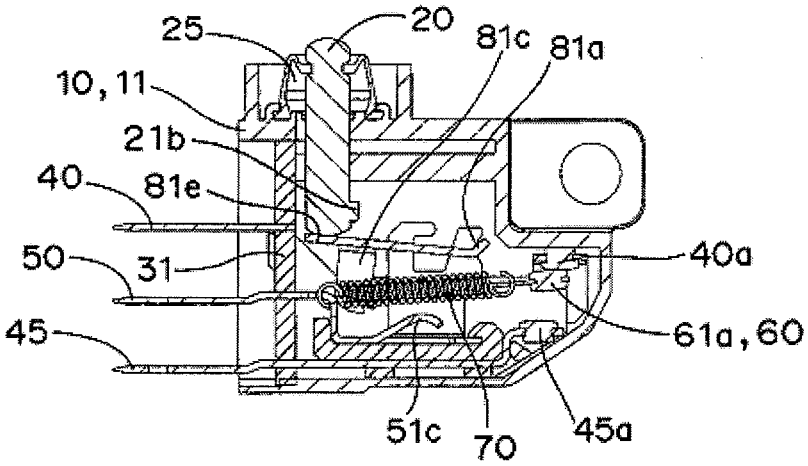
Figure 8A:
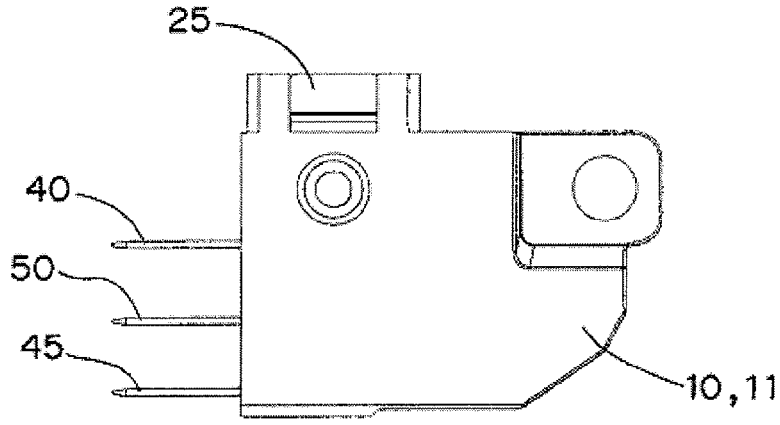
FIGS. 8A, 8B, and 8C are a front view describing the operation process, a cross-sectional view cut at a position of removing only the side wall on the front surface side of the housing, and a cross-sectional view cut at a position of vertically dividing the operating element in half.
Figure 8B:
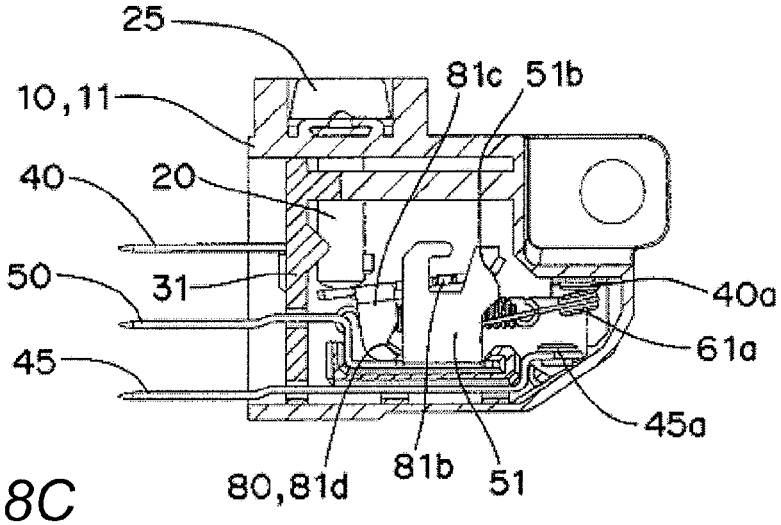
Figure 8C:
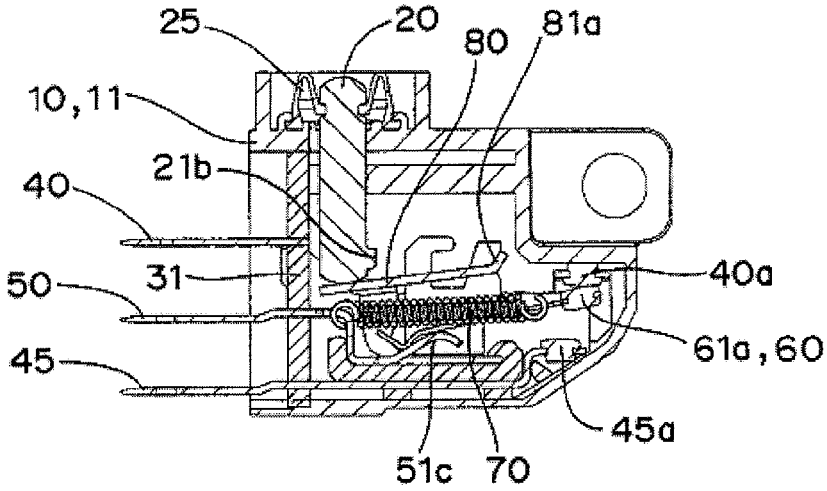
Figure 9A:
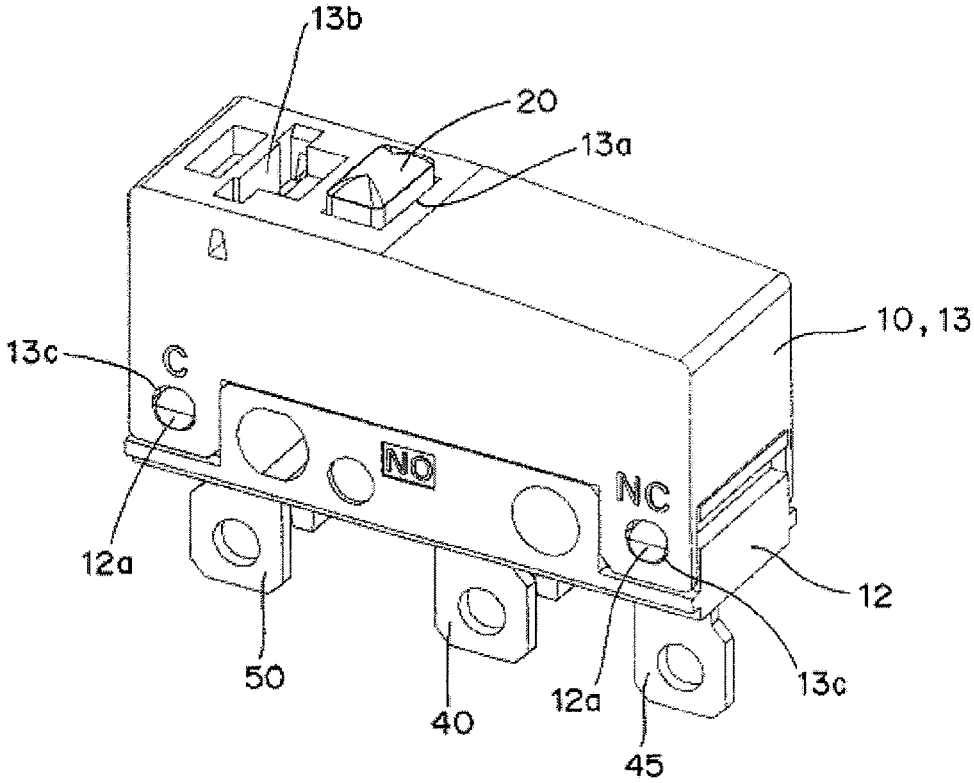
FIGS. 9A and 9B are perspective views showing a switch according to a second embodiment of the present invention.
Figure 9B:
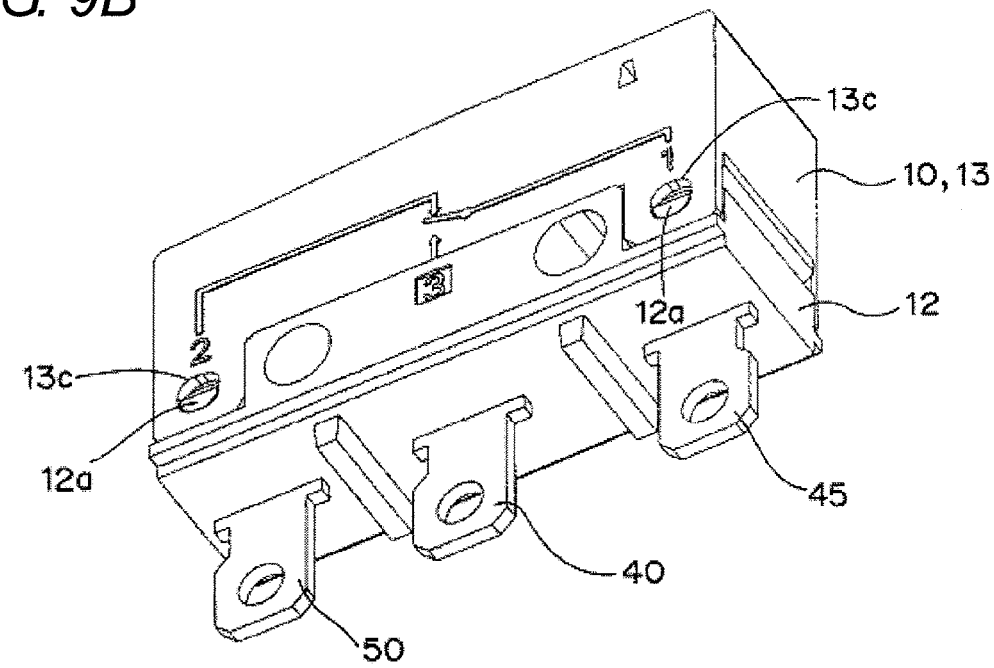

As shown in FIGS. 6A to 6C, when the operation receiving portion 81*e* of the operation piece 80 is pushed down with the operating element 20, the engagement shaft portion 81*a* of the operation piece 80 turns with the lock receiving portion 51*b* of the raised piece 51 as the supporting point. When the lock receiving portion 81*d* of the operation piece 80 goes over the reference line (not shown) connecting both ends 71*a*, 71*b* of the coil spring 70, the movable contact piece 60 is inverted and the movable contact 61*a* is switched from the always-closed fixed contact 45*a* to the always-opened fixed contact 40*a* (FIGS. 7A to 7C). Furthermore, when the operating element 20 is pushed down, the movable contact 61*a* is brought into contact with the always-opened fixed contact 40 at a predetermined contact pressure (FIGS. 8A to 8C).

When the pushing force with respect to the operating element 20 is released, the movable contact piece 60 is turned in the reverse direction with the spring force of the coil spring 70, and the operating element 20 is pushed to the upper side. Thus, the movable contact 61*a* is switched from the always-opened fixed contact 40*a* to the always-closed fixed contact 45*a* to return to the original position. The operating element 20 does not move out from the housing 10 since the slip-out preventing projection 21*b* locks to the top surface of the housing 10.

In the course of operation, the vibration occurs by the extension and contraction of the coil spring 70 when the movable contact piece 60 is turned, where the tongue piece 51*c* arranged on the common terminal 50 is brought into contact with the coil spring 70 thus shifting the timing of increasing the amplitude and preventing the resonance phenomenon.

Similarly, the resonance phenomenon caused by the increase of the amplitude can be prevented even if an impact force is applied from the outside since the coil spring 70 is brought into contact with the tongue piece 51*c*.

As shown in FIGS. 9A and 9B to FIGS. 16A to 16C, the switch according to a second embodiment is configured by the housing 10, the operating element 20 attached to the housing 10, and the contact mechanism 30 incorporated in the housing 10 and operated by the operating element 20.

Figure 10:
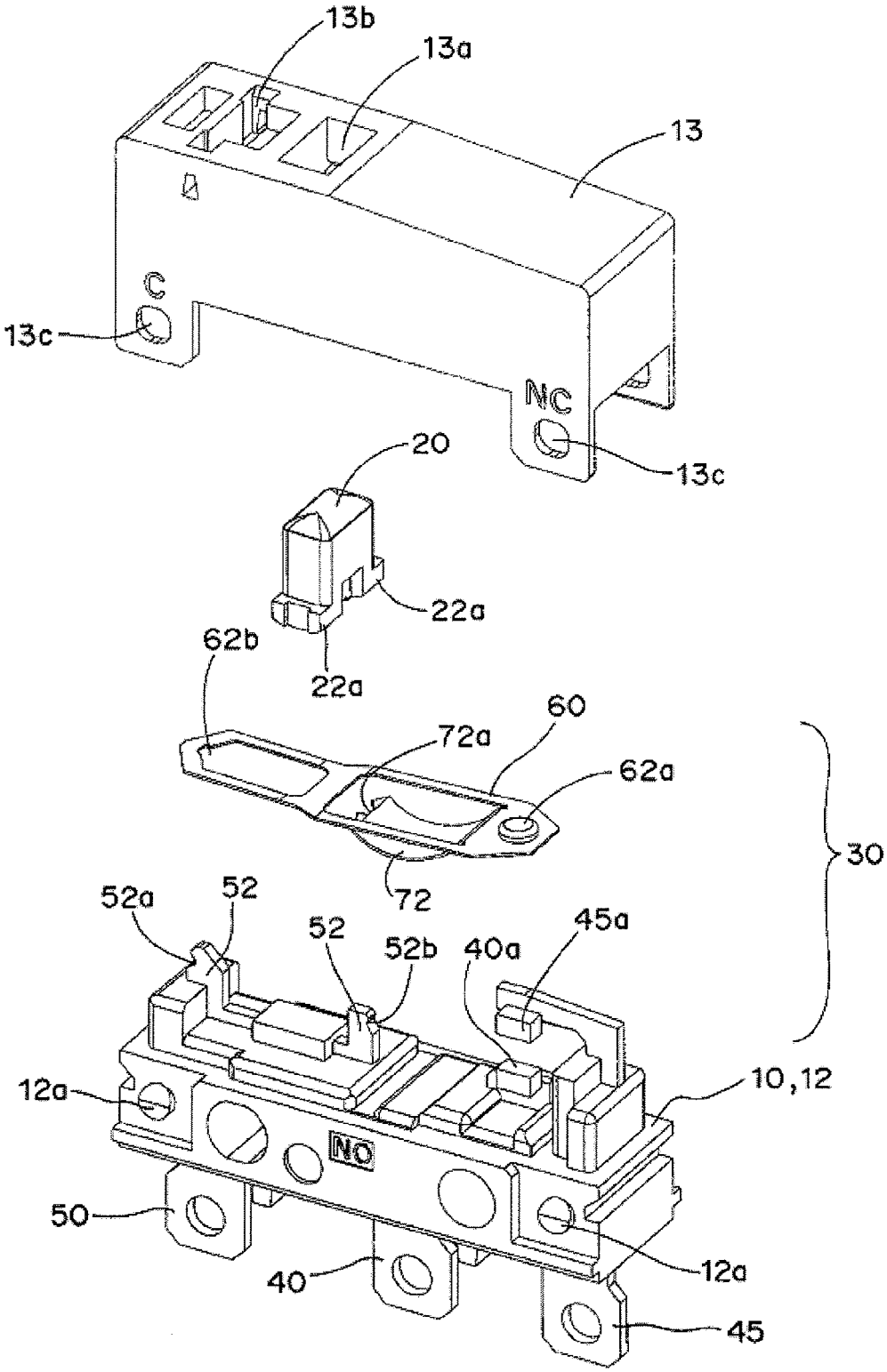
FIG. 10 is an exploded perspective view of the switch shown in FIG. 9A.

As shown in FIG. 10, the housing 10 is configured by a base 12 in which the always-opened fixed contact terminal 40, the always-closed fixed contact terminal 45, and the common terminal 50 are insert molded, and a cover 13 having a planar shape that can be fitted to the base 12. The contact mechanism 30 is configured by the always-opened fixed contact terminal 40, the always-closed fixed contact terminal 45, the common terminal 50, and the movable contact piece 60, to be described later.

The base 12 has the always-opened fixed contact terminal 40 and the always-closed fixed contact terminal 45 projected from the upper surface, where the always-opened fixed contact 40*a* and the always-closed fixed contact 45*a* are respectively arranged at the upper end, the always-opened fixed contact 40*a* and the always-closed fixed contact 45*a* being faced to each other. The base has a pair of projection pieces 52, 52 of the common terminal 50 projecting out at the upper surface, where lock receiving portions 52*a*, 52*b* are arranged at the outer side edge of the projection pieces 52, 52. Furthermore, the base 12 has an engagement nail portion 12*a* formed on both side surfaces facing each other.

Figure 11:
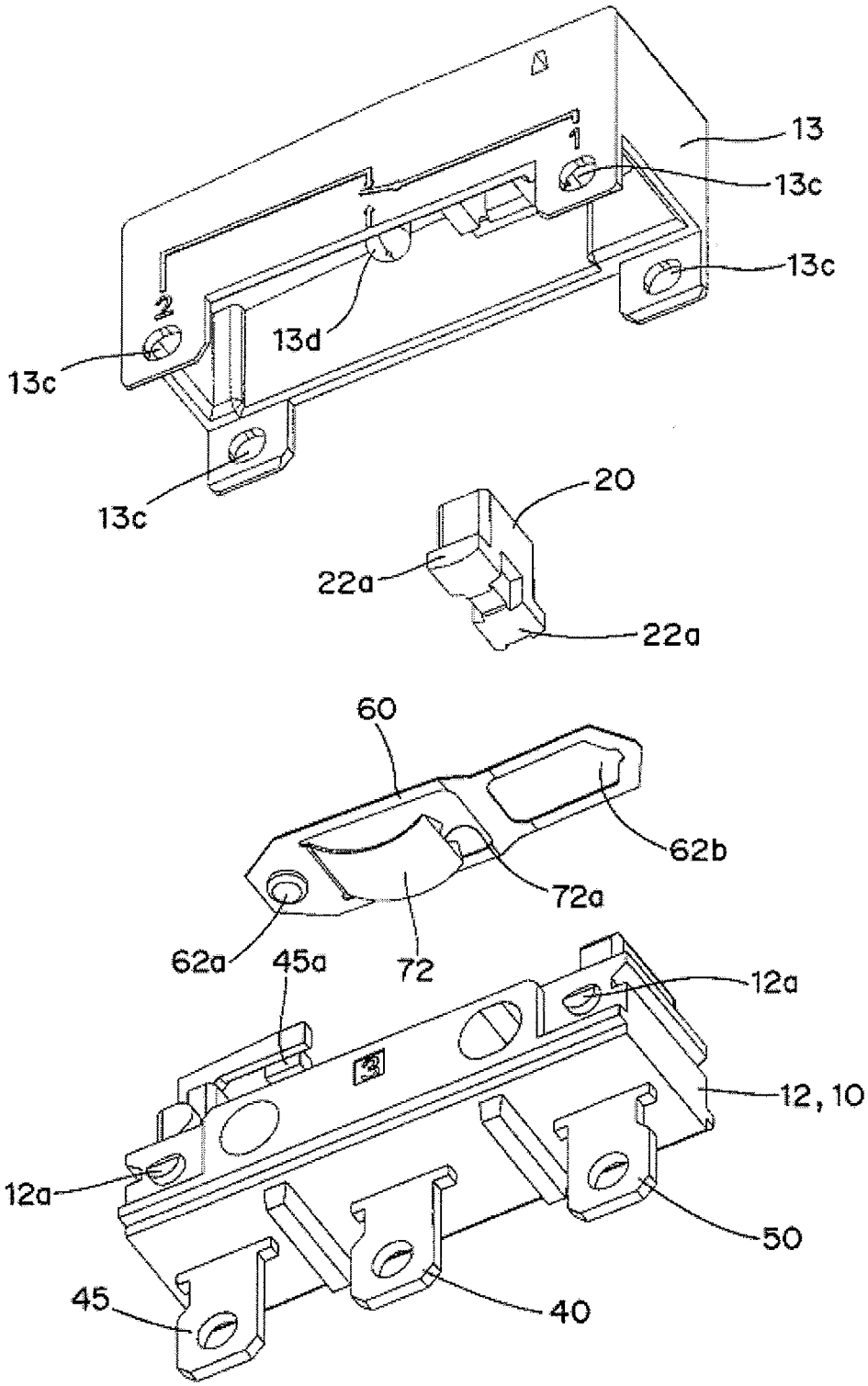
FIG. 11 is an exploded perspective view of the switch shown in FIG. 9B.

The cover 13 has a recessed area 13*b* for attaching the operation lever (not shown) formed in the vicinity of the operation hole 13*a* formed at the upper surface. The cover 13 has an engagement hole 13*c* formed at the corner on the lower side of the opposing side surface. Moreover, as shown in FIG. 11, the cover 13 has a projection 13*d* for position regulating a plate spring 72, to be described later, arranged in a projecting manner at the top surface.

As shown in FIG. 10, the movable contact piece 60 configuring the contact mechanism 30 is formed by performing press work on a conductive plate spring material, where a movable contact 62*a* is arranged on the end on the near side, and a fit-in hole 62*b* is formed on the far side. Furthermore, an arcuate plate spring 72 performed with bending work is cut out between the movable contact 62*a* and the fit-in hole 62*b*. A lock portion 72*a* is arranged at the free end of the plate spring 72.

The operating element 20 has a planar shape that can be fitted to the operation hole 13*a* of the cover 13, and has a pair of slip-out preventing projections 22*a*, 22*a* arranged in a projecting manner to the side at the lower end.

The assembly method according to one or more embodiments of the present invention will now be described.

Figure 12A:
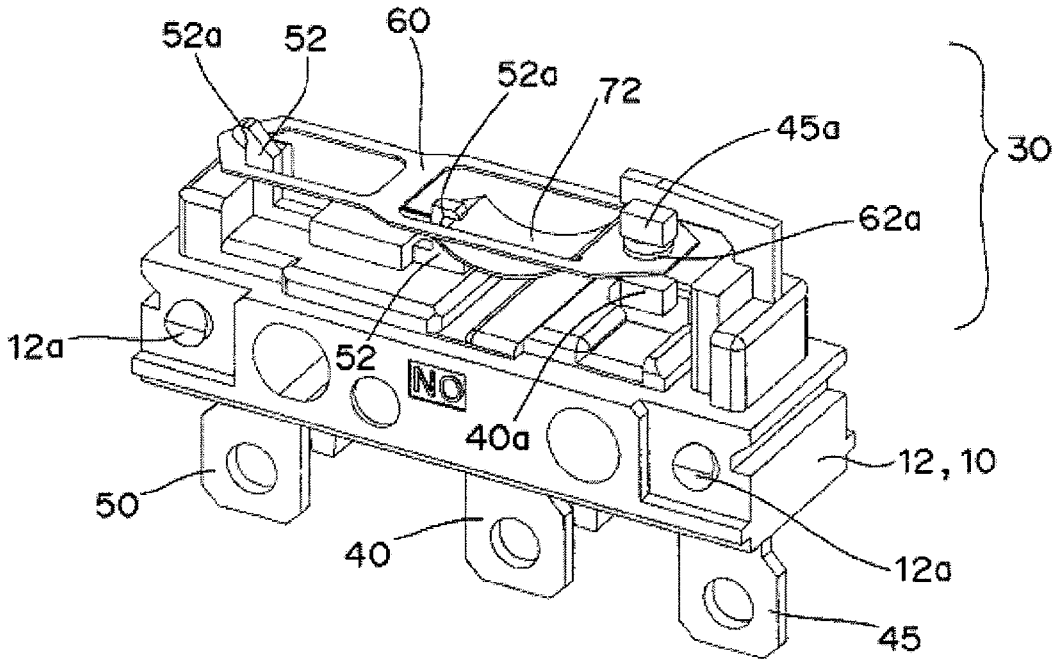
FIGS. 12A and 12B are perspective views showing a contact mechanism integrally molded with the base shown in FIGS. 1A to 1C.
Figure 12B:
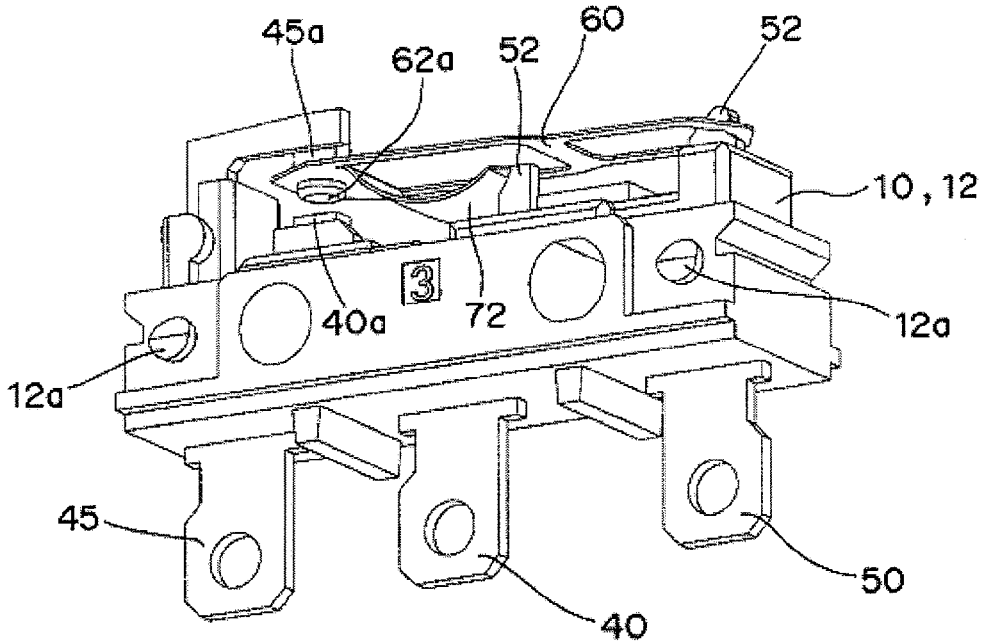

First, as shown in FIG. 10, an inner side edge of the fit-in hole 62*b* of the movable contact piece 60 is locked to the lock receiving portion 52*a* of the projection piece 52 on one side projecting out from the base 12, and the lock portion 72*a* of the plate spring 72 is locked to the lock receiving portion 52*b* of the projection piece 52 on the other side. The movable contact 62*a* is thus positioned between the always-opened fixed contact 40*a* and the always-closed fixed contact 45*a*, and is biased to the upper side (FIGS. 12A, 12B).

The cover 13 in which the operating element 20 is assembled to the operation hole 13*a* is fitted into the base 12, and the engagement nail portion 12*a* of the base 12 is engaged and integrated with the engagement hole 13*c* of the cover 13. The lower end of the operating element 20 shown in FIG. 11 is thereby brought into contact with the movable contact piece 60, and the projection 13*d* can be brought into contact with the plate spring 72 of the movable contact piece 60.

The operation method of the switch according one or more embodiments of the present invention will now be described.

Figure 13A:
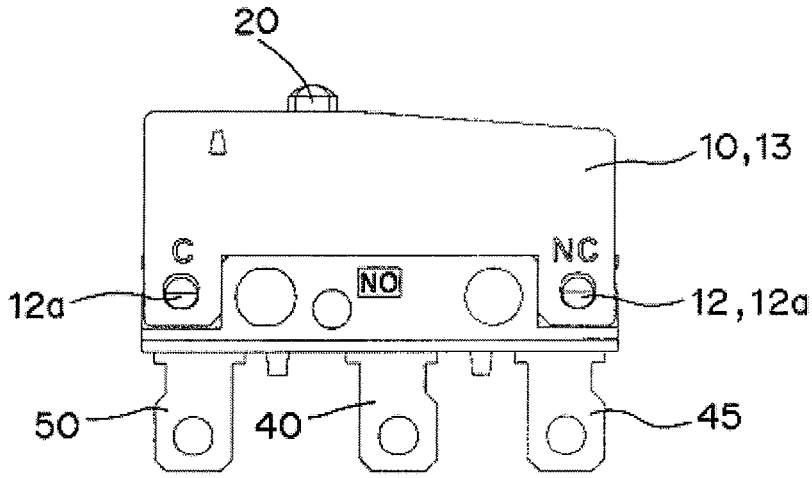
FIGS. 13A, 13B, and 13C are a front view describing the operation process, a cross-sectional view cut at a position of removing only the side wall on the front surface side of the housing, and a cross-sectional view cut at a position of vertically dividing the operating element in half.
Figure 13B:
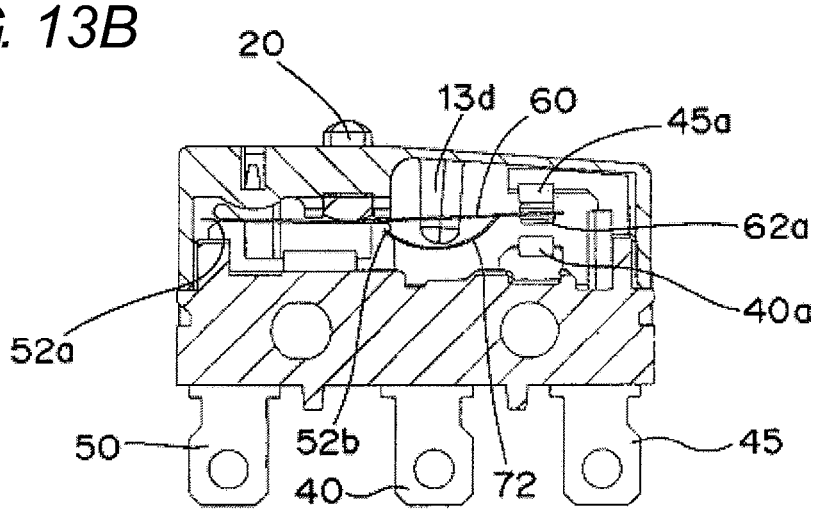
Figure 13C:
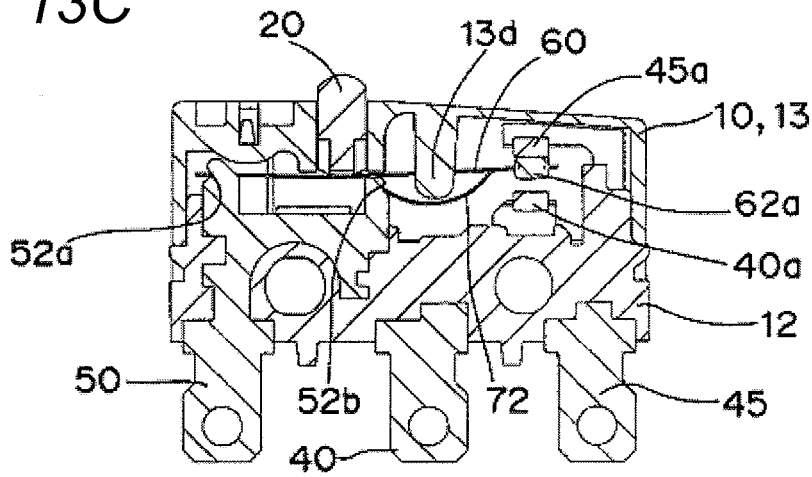
Figure 14A:
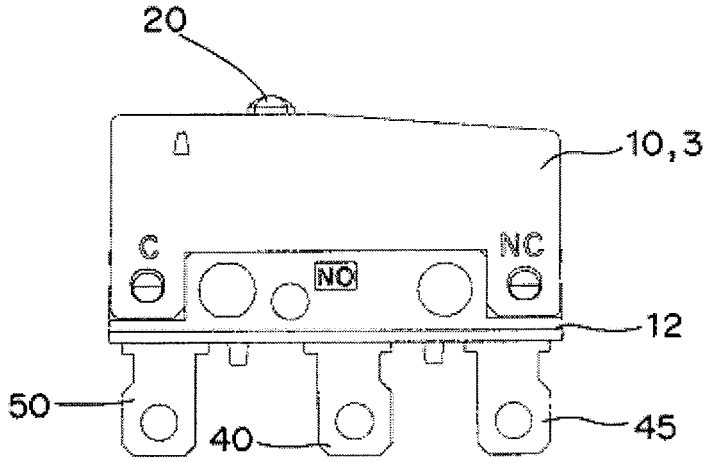
FIGS. 14A, 14B, and 14C are a front view describing the operation process, a cross-sectional view cut at a position of removing only the side wall on the front surface side of the housing, and a cross-sectional view cut at a position of vertically dividing the operating element in half.
Figure 14B:
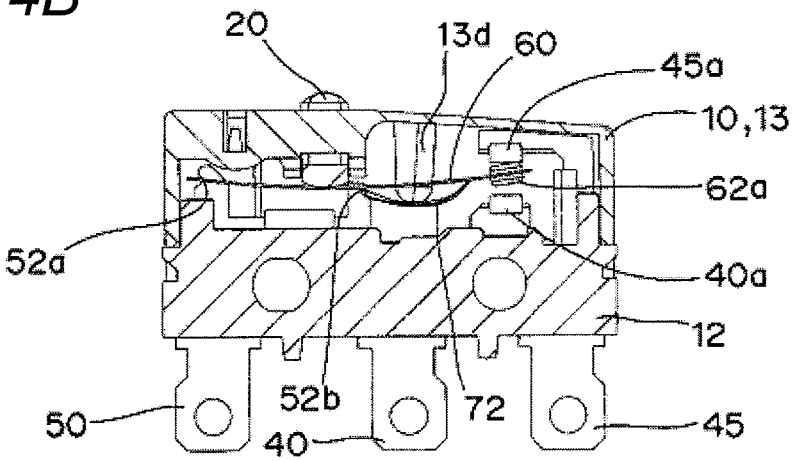
Figure 14C:
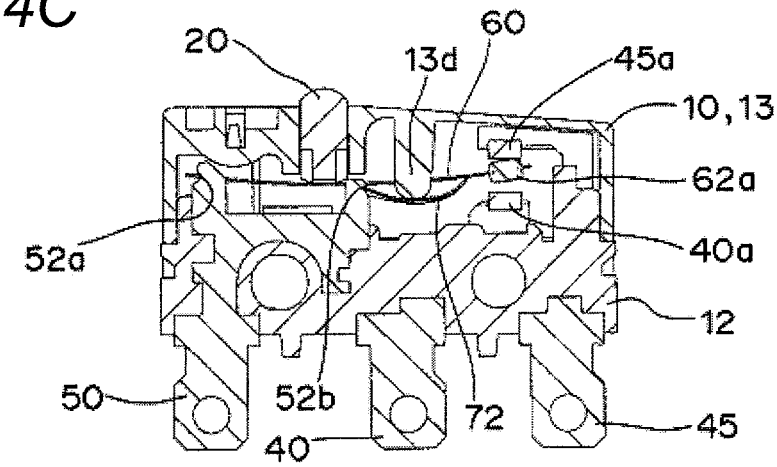
Figure 15A:
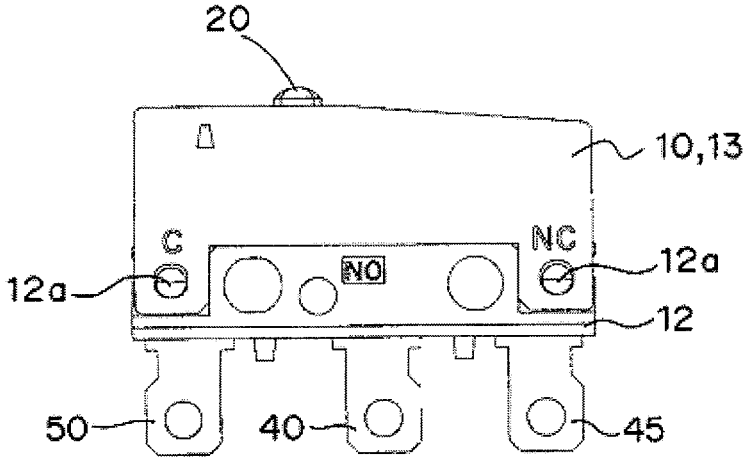
FIGS. 15A, 15B, and 15C are a front view describing the operation process, a cross-sectional view cut at a position of removing only the side wall on the front surface side of the housing, and a cross-sectional view cut at a position of vertically dividing the operating element in half.
Figure 15B:
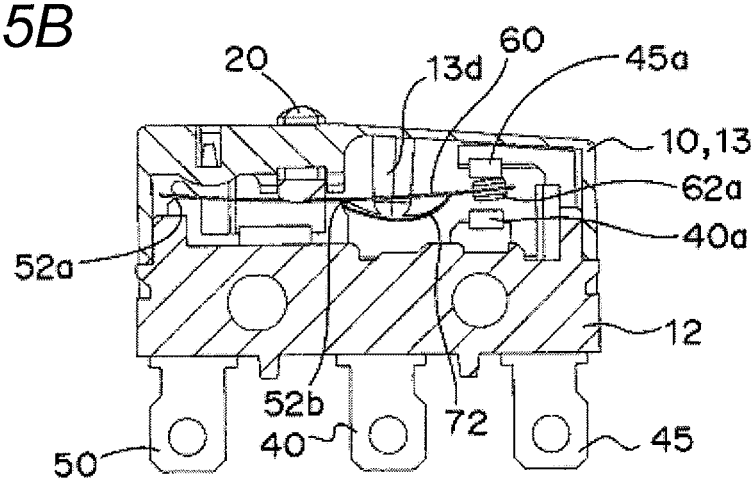
Figure 15C:
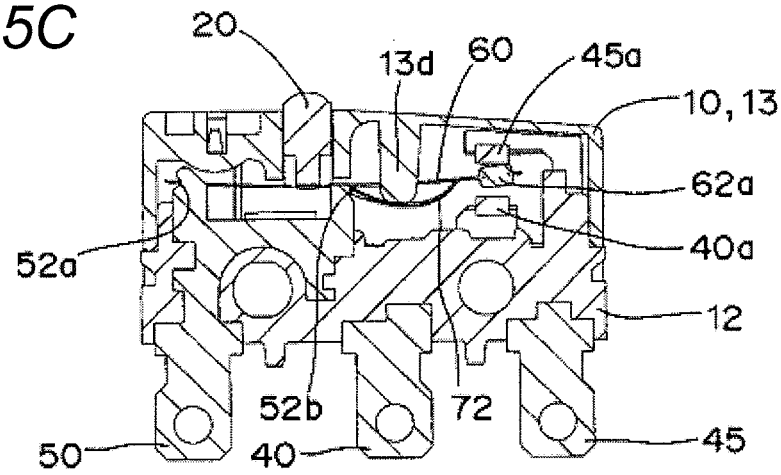

As shown in FIGS. 13A to 13C, the movable contact 62*a* is brought into contact with the always-closed fixed contact 45 at a predetermined contact pressure by the spring force of the plate spring 72 of the movable contact piece 60 when the operating element 20 is in the no-load state.

Figure 16A:
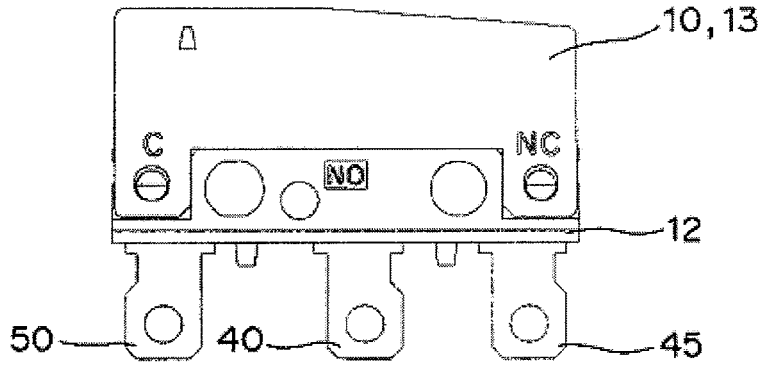
FIGS. 16A, 16B, and 16C are a front view describing the operation process, a cross-sectional view cut at a position of removing only the side wall on the front surface side of the housing, and a cross-sectional view cut at a position of vertically dividing the operating element in half.
Figure 16B:
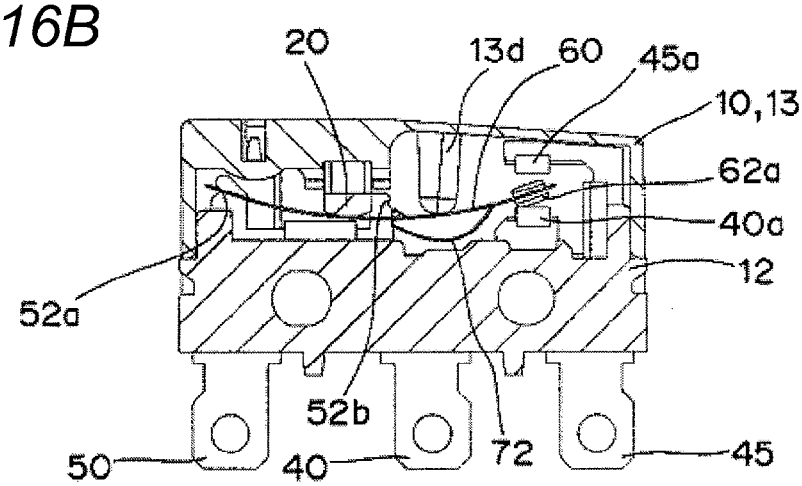
Figure 16C:
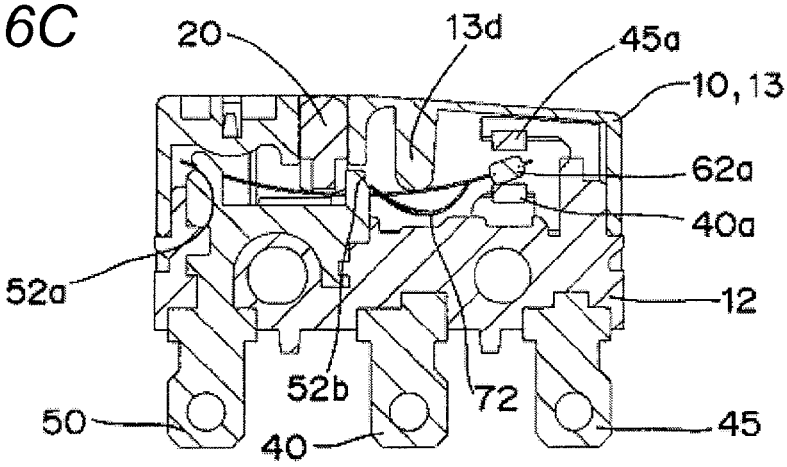
Figure 17A:
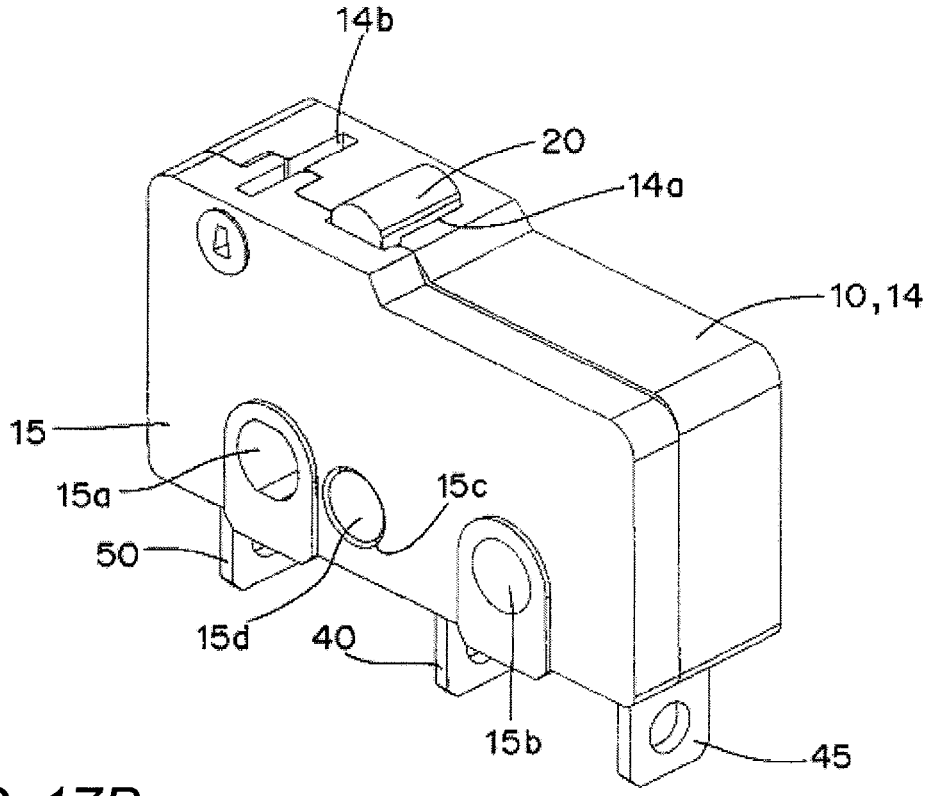
FIGS. 17A and 17B are perspective views showing a switch according to a third embodiment of the present invention.
Figure 17B:
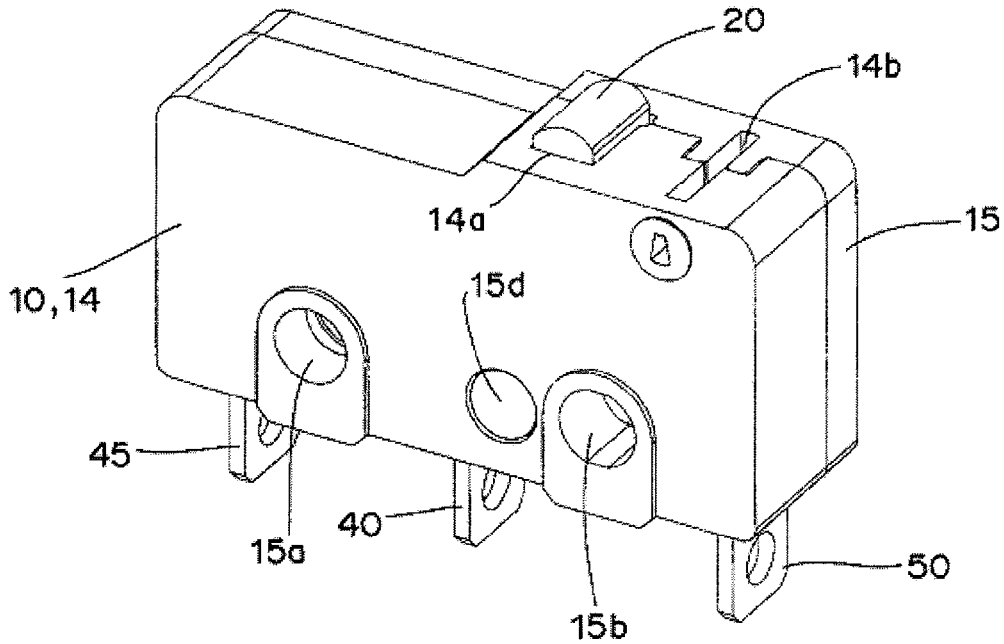

As shown in FIGS. 14A to 14C and FIGS. 15A to 15C, the movable contact piece 60 bends when the operating element 20 is pushed down. When the lower end of the operating element 20 goes over the reference line (not shown) connecting the lock receiving portions 52*a*, 52*b* of the projection pieces 52, 52, the movable contact piece 60 is inverted with the lock receiving portion 52*a* as a supporting point by the spring force of the plate spring 72 (FIGS. 16A to 16C). The movable contact 62*a* is thereby switched from the always-closed fixed contact 45*a* to the always-opened fixed contact 40*a*, and the movable contact 62*a* is brought into contact with the always-opened fixed contact 40 at a predetermined contact pressure by further pushing in the operating element 20.

When the load of the operating element 20 is released, the movable contact piece 60 is inverted by the spring force of the plate spring 72, and the movable contact 62*a* is switched from the always-opened fixed contact 40*a* to the always-closed fixed contact 45*a* to return to the original state.

The plate spring 72 elastically deforms and vibrates when the movable contact piece 60 is turned, but the position regulating projection 13*d* of the cover 13 is brought into contact with the plate spring 72 thus shifting the timing of increasing the amplitude and preventing the resonance phenomenon.

Similarly, the resonance phenomenon caused by the increase of the amplitude can be prevented even if an impact force is applied from the outside since the plate spring 72 is brought into contact with the projection 13*d* of the cover 13. In particular, the slip-out of the movable contact piece 60 can be prevented even if horizontal oscillation is applied since the distal end of the projection 13*d* is fitted to the movable contact piece 60.

As shown in FIGS. 17A and 17B to FIGS. 24A to 24C, a switch according to a third embodiment has the contact mechanism 30 incorporated in the housing 10 formed by the base 14 and the cover 15, and has the contact mechanism 30 operable with the operating element 20 assembled to the housing 10.

Figure 18:
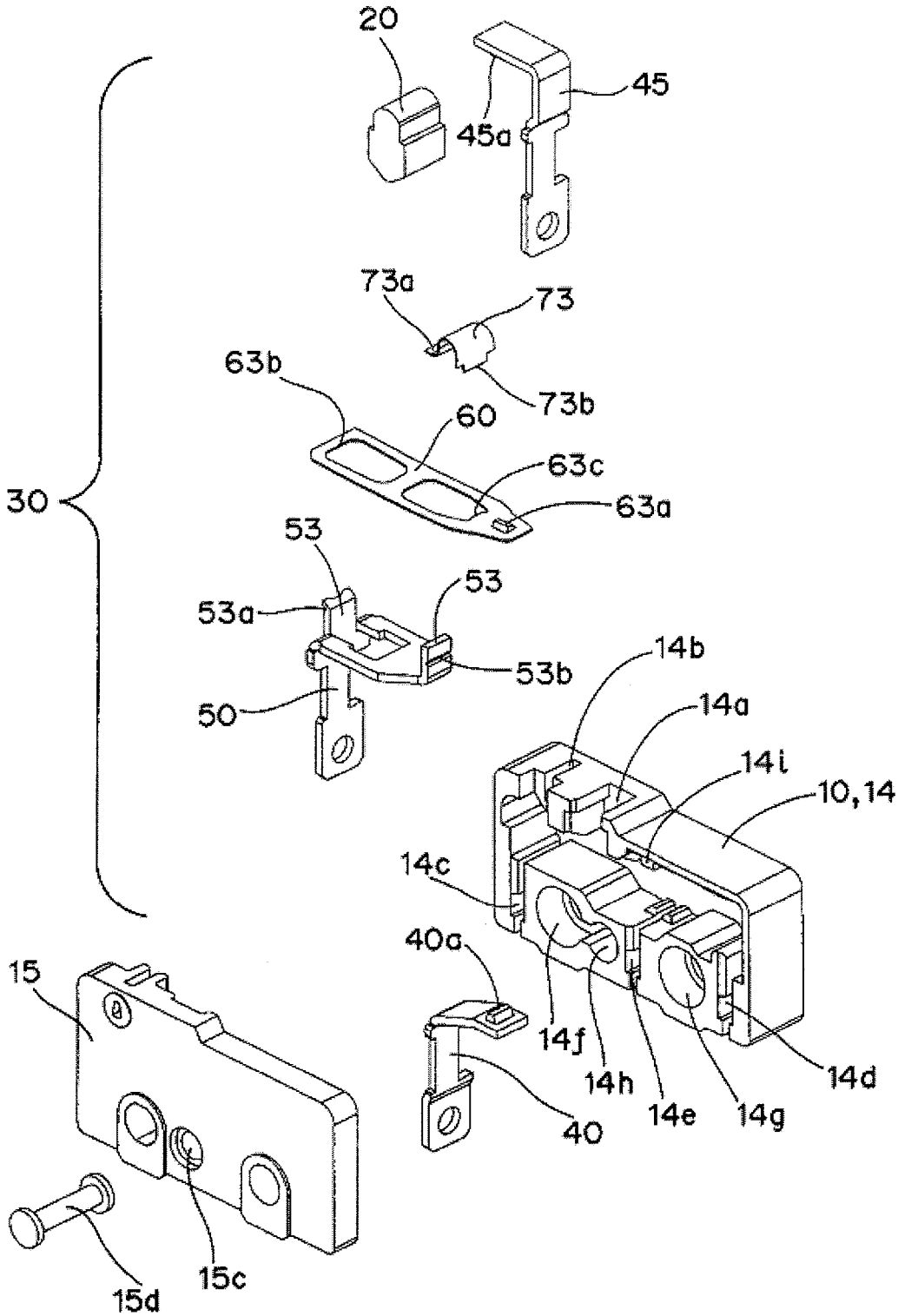
FIG. 18 is an exploded perspective view of the switch shown in FIG. 17A.

As shown in FIG. 18, the base 14 includes an operation hole 14*a* for assembling the operating element 20, and includes an attachment hole 14*b* for assembling an operation lever (not shown) in the vicinity of the operation hole 14*a*. The base 10 includes slits 14*c*, 14*d*, 14*e* to which the common terminal 50, the always-closed fixed contact terminal 45, and the always-opened fixed contact terminal 40 can be press fit from the side. The base 10 includes a pair of attachment holes 14*f*, 14*g*, and a rivet hole 14*e* is formed between the attachment holes 14*f*, 14*g*. The base 10 has a projection 14*i* arranged in a projecting manner at the top surface.

Figure 19:
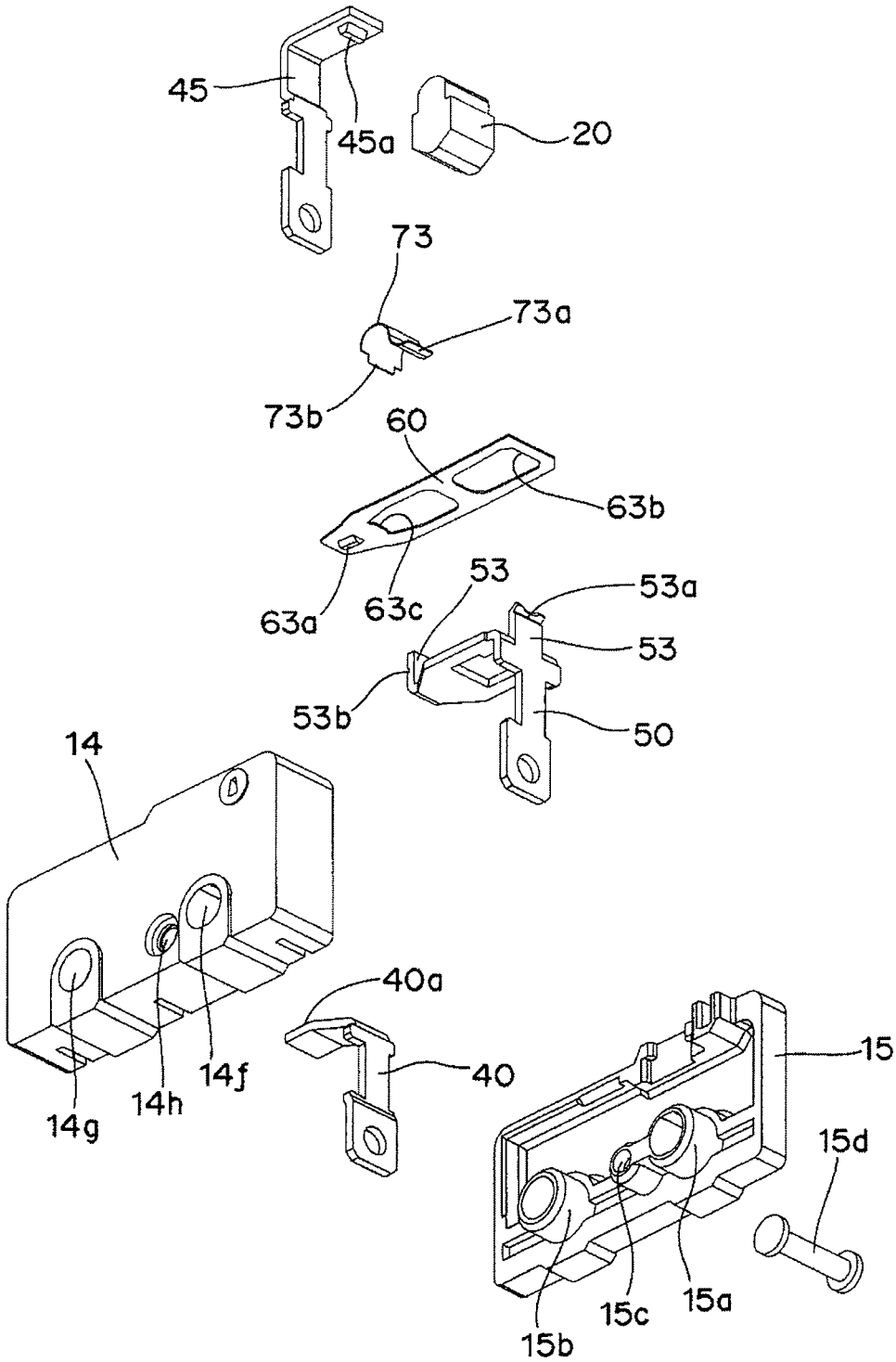
FIG. 19 is an exploded perspective view in which the switch shown in FIG. 17B is viewed from the lower side.

As shown in FIG. 19, the cover 15 has a side surface shape that can be fitted to the base 14, where fit-in bosses 15*a*, 15*b* are arranged at positions corresponding to the attachment holes 14*f*, 14*f*, and a rivet hole 15*c* is also formed.

As shown in FIG. 18, the contact mechanism 30 includes the always-opened fixed contact terminal 40 and the always-closed fixed contact terminal 45 respectively including the always-opened fixed contact 40*a* and the always-closed fixed contact 45*a* at the upper end, and the common terminal 50 for assembling the movable contact piece 60 and a curved plate spring 73.

The common terminal 50 is formed with lock receiving portions 53*a*, 53*b* on the outward surface of a pair of projection pieces 53, 53 formed by bending through press working.

The movable contact piece 60 includes a movable contact 63*a* at one end and is formed with a pair of play-fit holes 63*b*, 63*c* by punching out a conductive plate spring.

The plate spring 73 is formed by curving a band-shaped spring material through press working, where one end 73*a* and the other end 73*b* can be locked.

The assembly method according to the third embodiment will now be described.

Figure 20A:
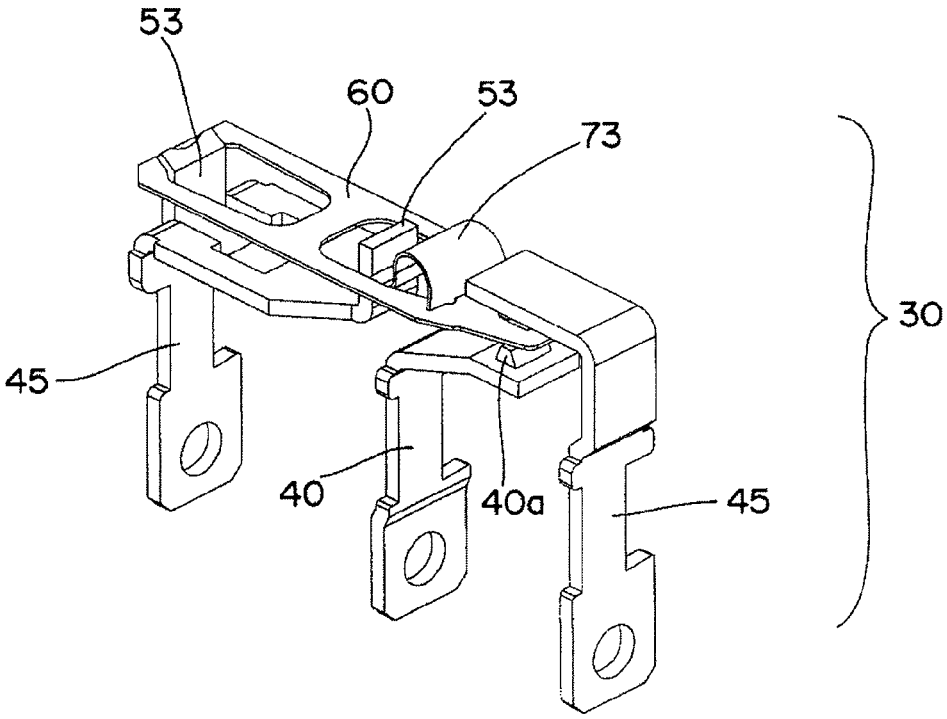
FIGS. 20A and 20B are perspective views showing a contact mechanism of the switch shown in FIGS. 17A and 17B.
Figure 20B:
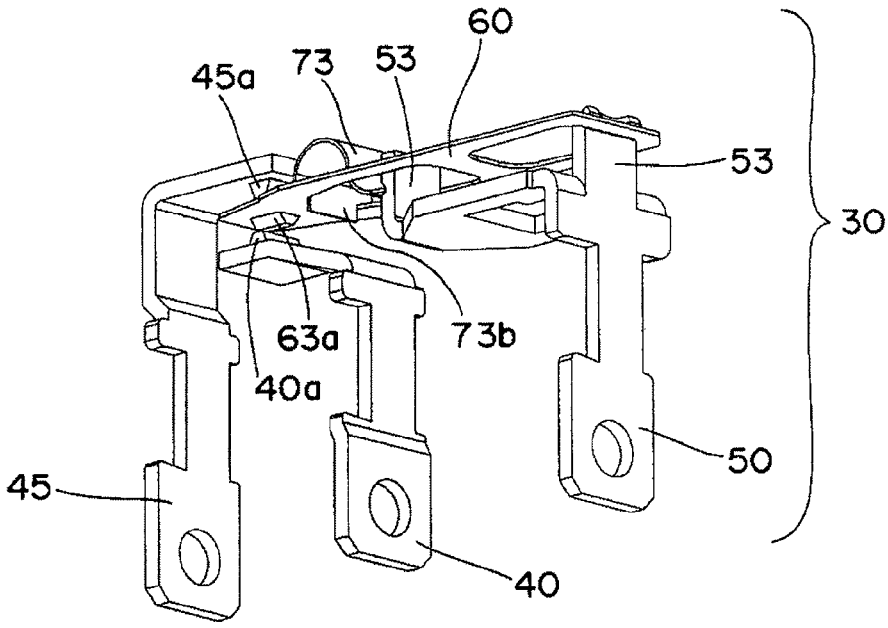

First, as shown in FIG. 18, the inner side edge of the play-fit hole 63*a* formed in the movable contact piece 60 is locked to the lock receiving portion 53*a* formed at the projection piece 53 of the common terminal 50, one end 73*a* of the plate spring 73 is locked to the lock receiving portion 53*b* formed at the projection piece 53, and the other end 73*b* of the plate spring 73 is locked to the inner side edge of the play-fit hole 63*c* (see FIGS. 20A, 20B). The common terminal 50 is then press fit and positioned in the slit 14*c* of the base 14 shown in FIG. 18, and the always-closed fixed contact terminal 45 and the always-opened fixed contact terminal 40 are respectively press fit and positioned in the slits 14*d*, 14*e*. The movable contact 63*a* is thus positioned between the always-closed fixed contact 45*a* and the always-opened fixed contact 40*a*, and is biased to the upper side. Thereafter, the operating element 20 is fitted into the operation hole 14*a* of the base 14, and then the positioning bosses 15*a*, 15*b* of the cover 15 are inserted to the attachment holes 14*f*, 14*g* of the base 14 shown in FIG. 19. The rivet 15*d* is then inserted and caulked in the rivet holes 14*h*, 15*c*, whereby the assembly task is completed.

The operation method of the switch according to the third embodiment will now be described.

Figure 21A:
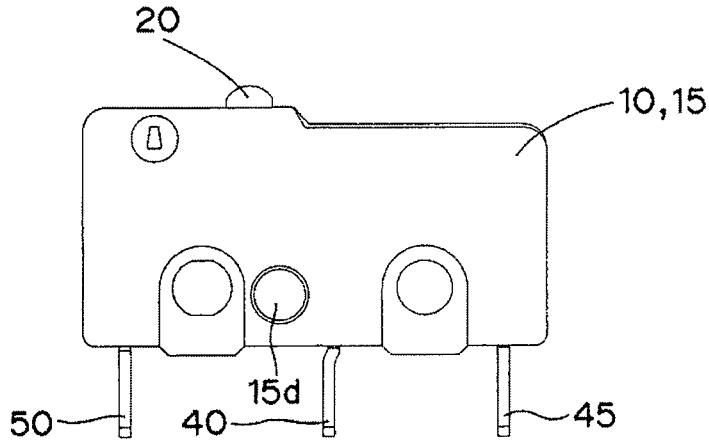
FIGS. 21A, 21B, and 21C are a front view describing the operation process, a cross-sectional view cut at a position of removing only the side wall on the front surface side of the housing, and a cross-sectional view cut at a position of vertically dividing the operating element in half.
Figure 21B:
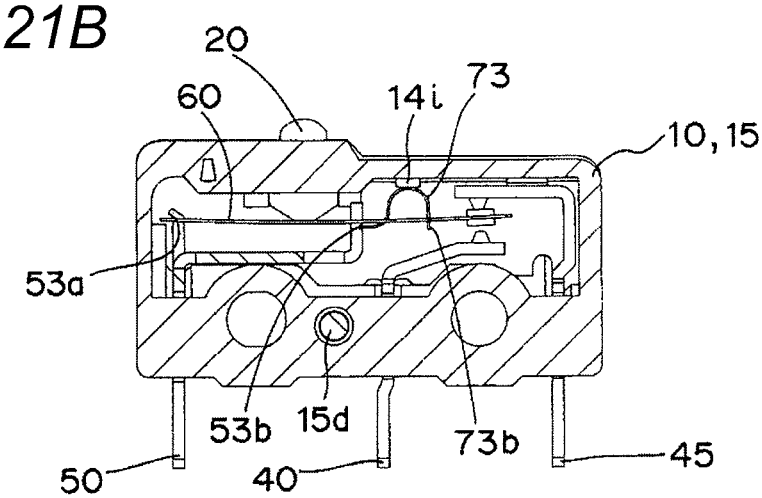
Figure 21C:
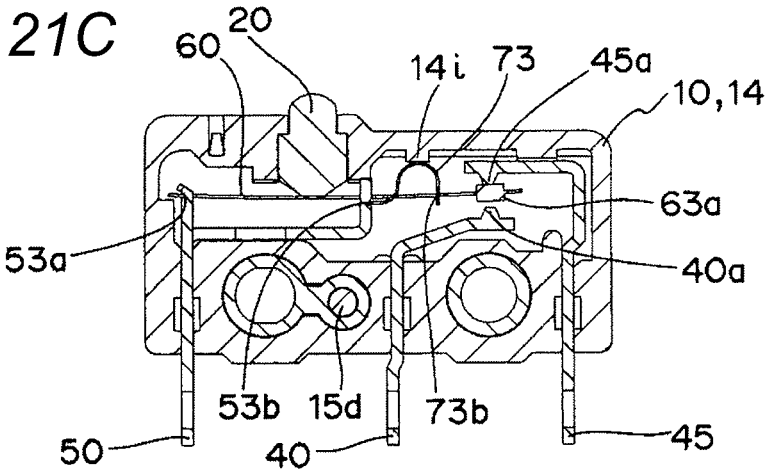

As shown in FIGS. 21A to 21C, if the operating element 20 is in the no-load state, the movable contact 63*a* is brought into contact with the always-closed fixed contact 45*a* at a predetermined contact pressure by the spring force of the plate spring 73 assembled to the movable contact piece 60.

Figure 22A:
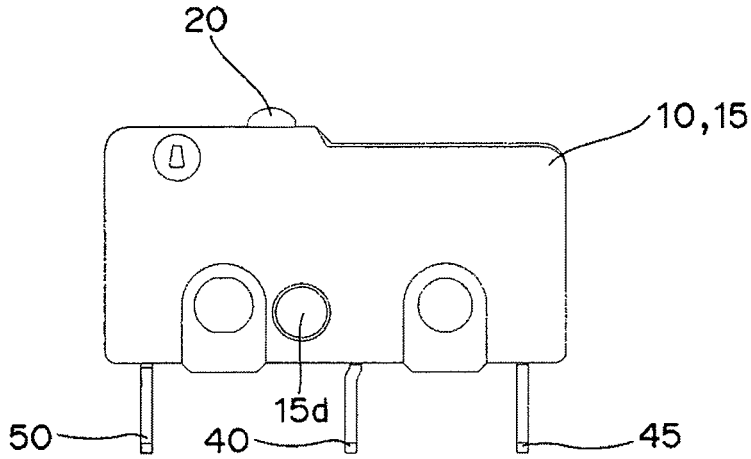
FIGS. 22A, 22B, and 22C are a front view describing the operation process, a cross-sectional view cut at a position of removing only the side wall on the front surface side of the housing, and a cross-sectional view cut at a position of vertically dividing the operating element in half.
Figure 22B:
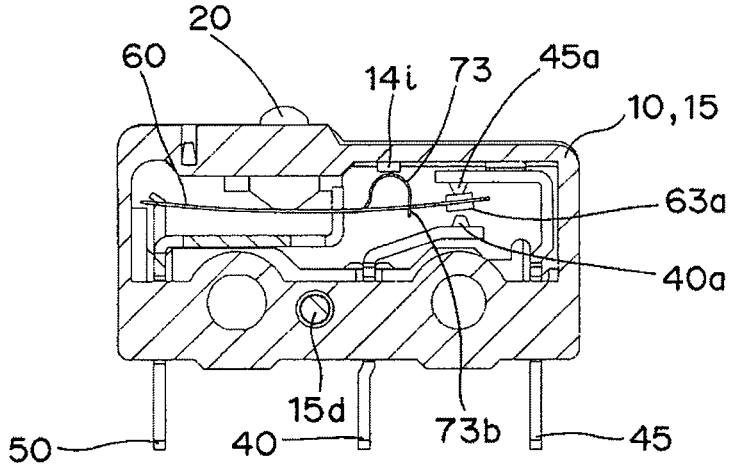
Figure 22C:
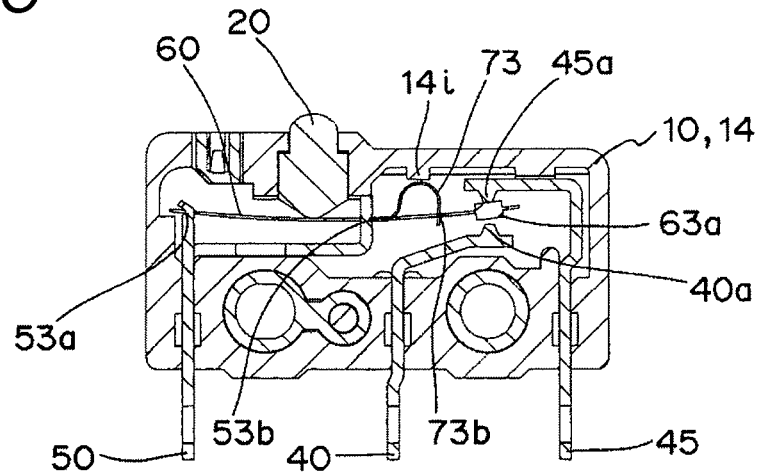
Figure 23A:
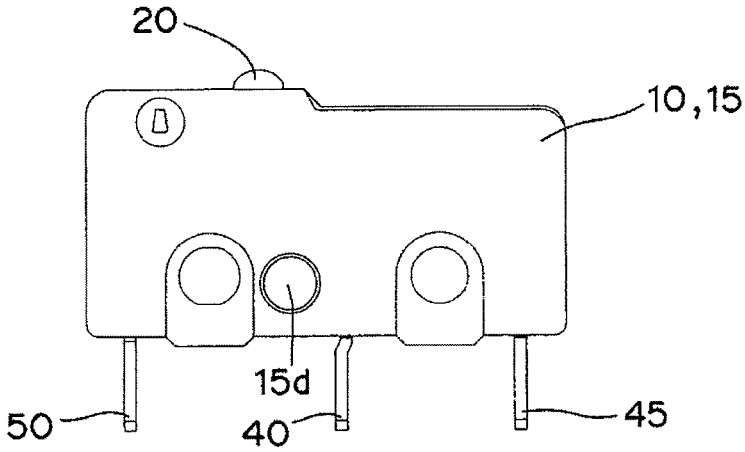
FIGS. 23A, 23B, and 23C are a front view describing the operation process, a cross-sectional view cut at a position of removing only the side wall on the front surface side of the housing, and a cross-sectional view cut at a position of vertically dividing the operating element in half.
Figure 23B:
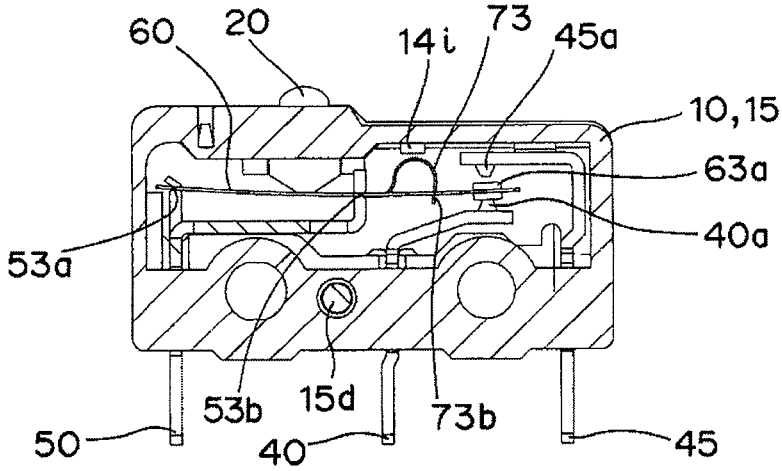
Figure 23C:
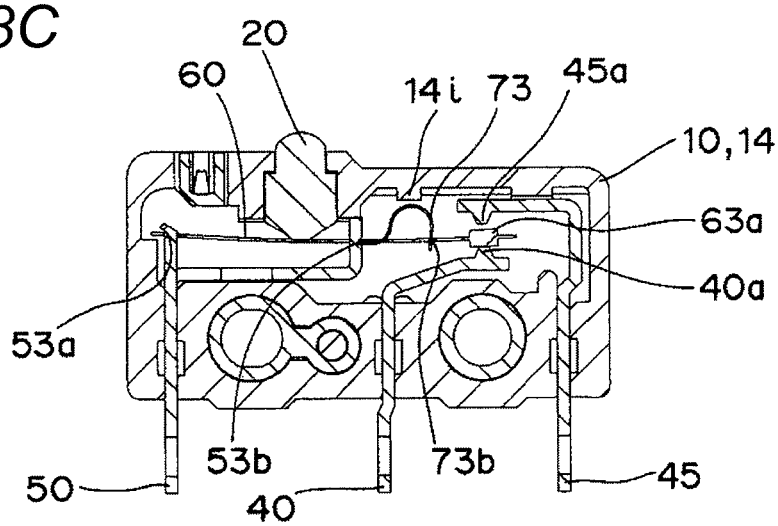
Figure 24A:
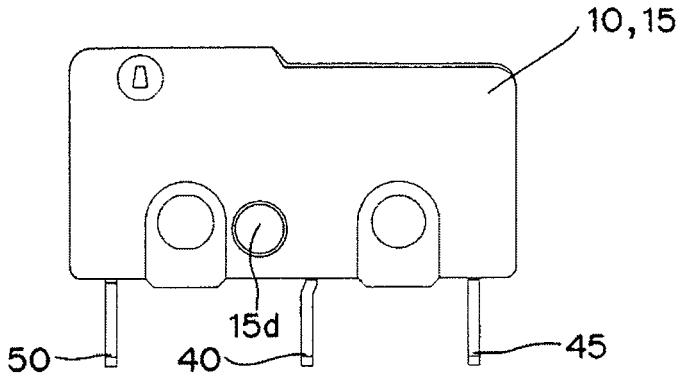
FIGS. 24A, 24B, and 24C are a front view describing the operation process, a cross-sectional view cut at a position of removing only the side wall on the front surface side of the housing, and a cross-sectional view cut at a position of vertically dividing the operating element in half.
Figure 24B:
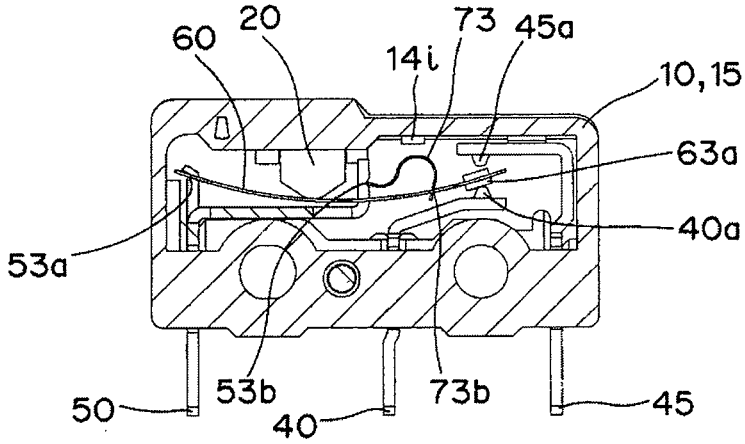
Figure 24C:
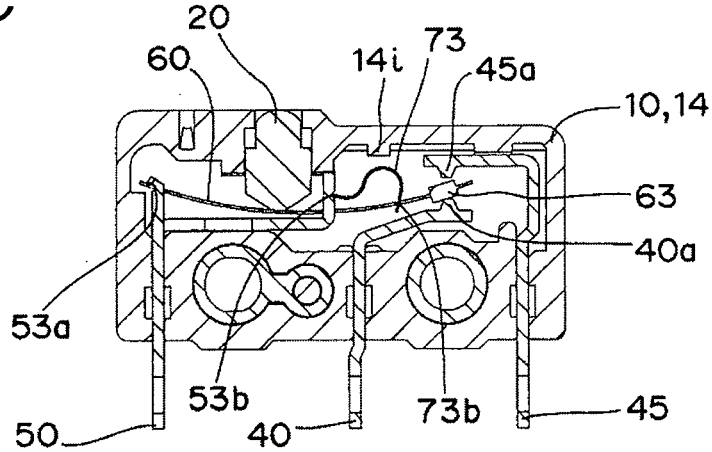

As shown in FIGS. 22A to 22C, the movable contact piece 60 bends when the operating element 20 is pushed down. When the reference line (not shown) connecting the lock receiving portion 53*a* of the projection piece 53 and the other end 73*b* of the plate spring 73 goes over the lock receiving portion 53*b* of the projection piece 53, the movable contact piece 60 inverts with the lock receiving portion 53*a* as the supporting point by the spring force of the plate spring 73 (FIGS. 23A to 23C). Therefore, the movable contact 63*a* switches from the always-closed fixed contact 45*a* to the always-opened fixed contact 40*a*, and when the operating element 20 is further pushed in, the movable contact 63*a* is brought into contact with the always-opened fixed contact 40*a* at a predetermined contact pressure (FIGS. 24A to 24C).

When the load of the operating element 20 is released, the movable contact piece 60 is inverted by the spring force of the plate spring 73, and the movable contact 63*a* is switched from the always-opened fixed contact 40*a* to the always-closed fixed contact 45*a* to return to the original state.

The plate spring 73 elastically deforms and vibrates when the movable contact piece 60 is turned, but the plate spring 73 is brought into contact with the projection 14*i* arranged on the base 14 thus shifting the timing of increasing the amplitude and preventing the resonance phenomenon.

Similarly, the resonance phenomenon can be prevented even if an impact force is applied from the outside since the plate spring 73 is brought into contact with the projection 14*i* of the cover 15.

As shown in FIGS. 25A to 25C to FIGS. 32A to 32C, a switch according to a fourth embodiment has the contact mechanism 30 assembled in the housing 10 formed by a base 16 and a cover 17, by which contact mechanism 30 can be operated with the operating element 20 assembled to the housing 10.

Figure 25A:
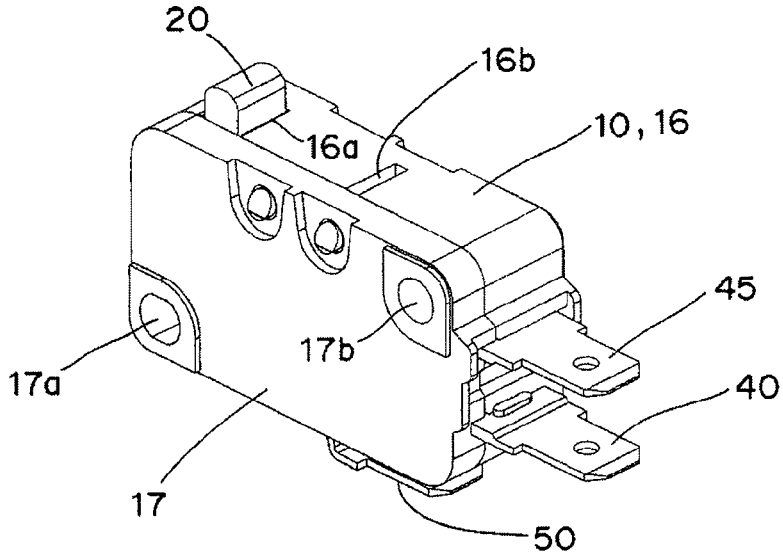
FIGS. 25A, 25B, and 25C are perspective views showing a switch according to a fourth embodiment of the present invention.
Figure 25B:
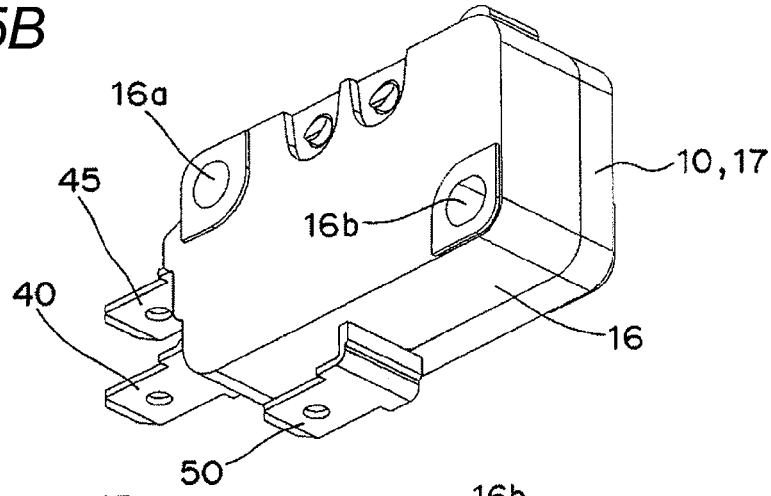
Figure 25C:
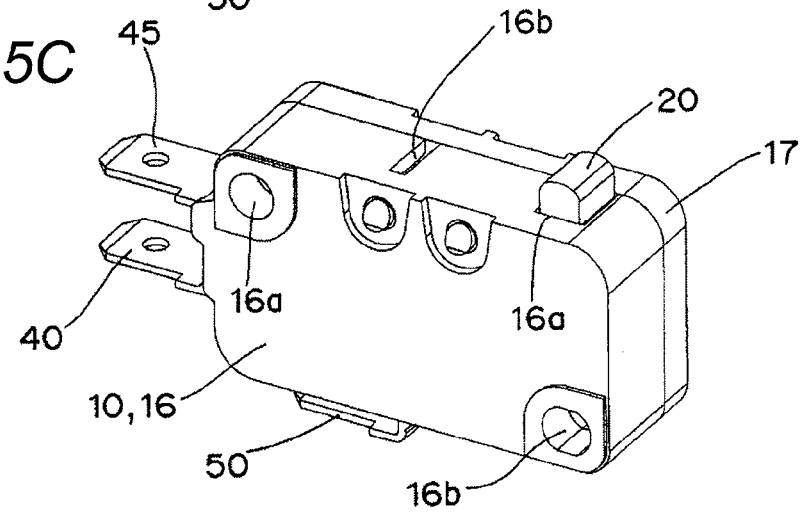
Figure 26:
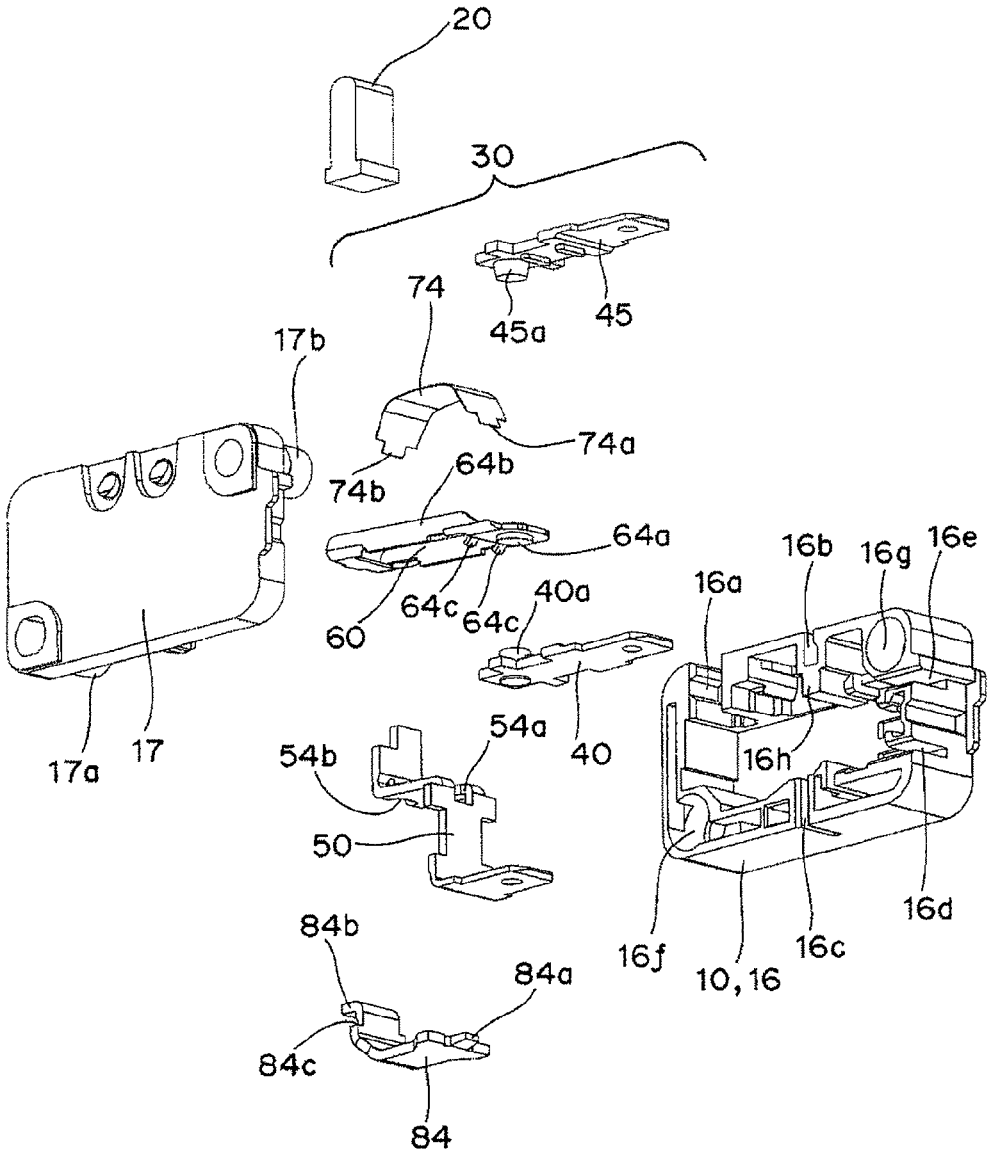
FIG. 26 is an exploded perspective view in which the switch shown in FIG. 25A is viewed from the lower side.
Figure 27:
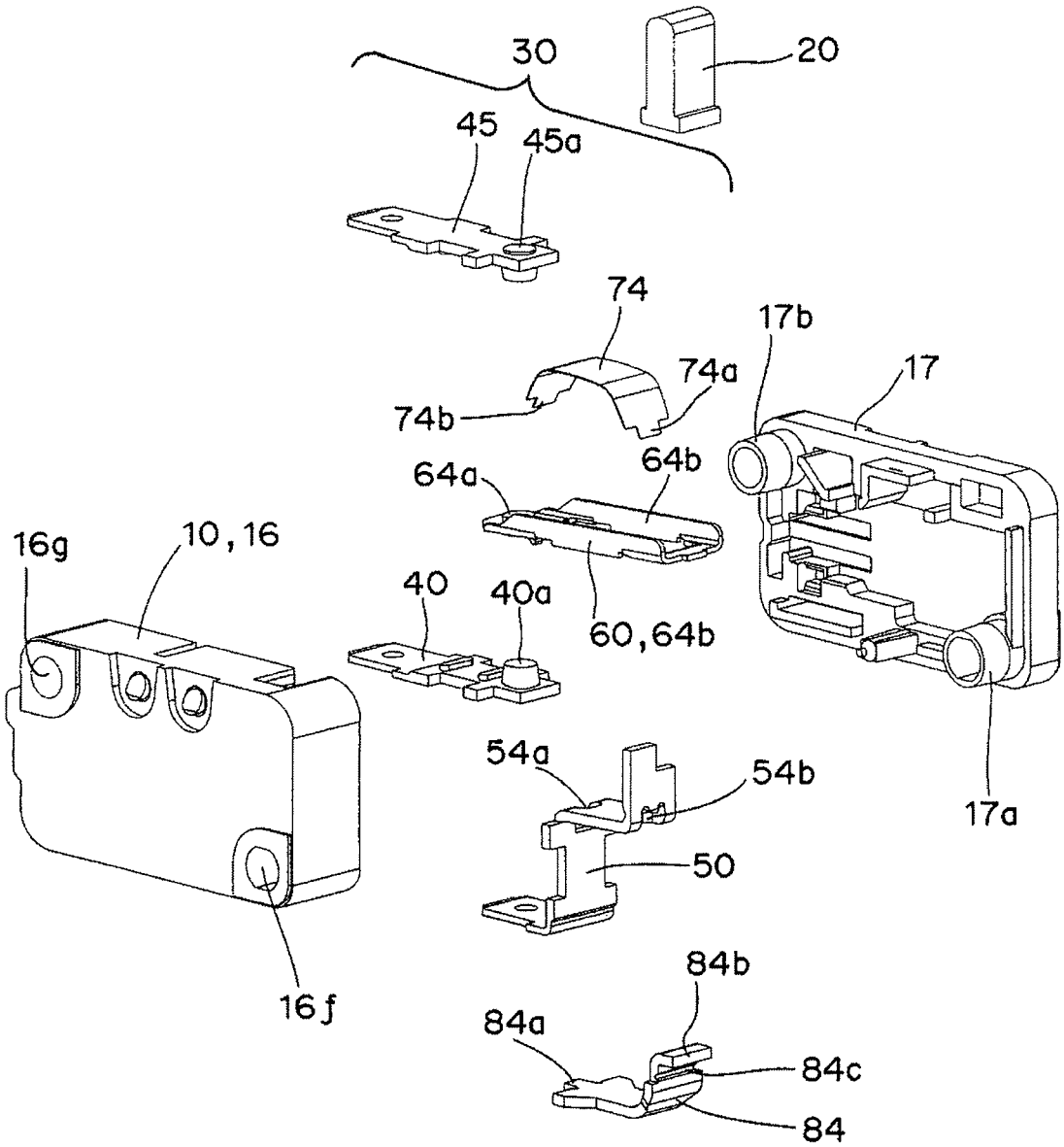
FIG. 27 is an exploded perspective view of the switch shown in FIG. 25C.

As shown in FIGS. 25A to 25C, the base 16 includes an operation hole 16*a* for assembling the operating element 20 at the upper surface, and a recess 16*b* for assembling an operation lever (not shown). As shown in FIG. 26, the base 16 includes slits 16*c*, 16*d*, 16*e* to which the common terminal 50, the always-opened fixed contact terminal 40, and the always-closed fixed contact terminal 45 can be press fit from the side. Furthermore, base 16 has attachment holes 16*f*, 16*g* formed at the opposing corners. A projection 16*h* is arranged between the operation hole 16*a* and the attachment hole 16*g* (FIG. 27).

The cover 17 has a side surface shape capable of being fitted into the base 16, and includes press-fit bosses 17*a*, 17*b* at positions corresponding to the attachment holes 16*f*, 16*g*.

As shown in FIG. 26, the contact mechanism 30 includes the common terminal 50 for assembling the movable contact piece 60, the plate spring 74, and the operation piece 84, and the always-opened fixed contact terminal 40 and the always-closed fixed contact terminal 45 having the always-opened fixed contact 40*a* and the always-closed fixed contact 45*a* arranged at one end.

The common terminal 50 is formed to a step-form through press working, and includes lock receiving portions 54*a*, 54*b* including through-holes at the corners.

The movable contact piece 60 includes a movable contact 64*a* at one end by punching out a conductive plate spring and is formed with reinforcement ribs 64*b*, 65*b* by bending and raising both side edges. A pair of lock nails 64*c*, 64*c* is bent and raised at the opening edge in the vicinity of the movable contact 64*a* of the opening edge of the movable contact piece 60.

The plate spring 74 is formed by curving a band-shaped spring material through press working, where one end 74*a* and the other end 74*b* have a lockable shape.

As shown in FIG. 27, the operation piece 84 is bent to a substantially L-shape, where a lock portion 84*a* is formed at the distal end of the horizontal portion, an operation receiving portion 84*b* is formed at the upper end of the vertical portion, and a lock receiving portion 84*c* is formed at the outward surface.

The assembly method according to the fourth embodiment will now be described.

Figure 28A:
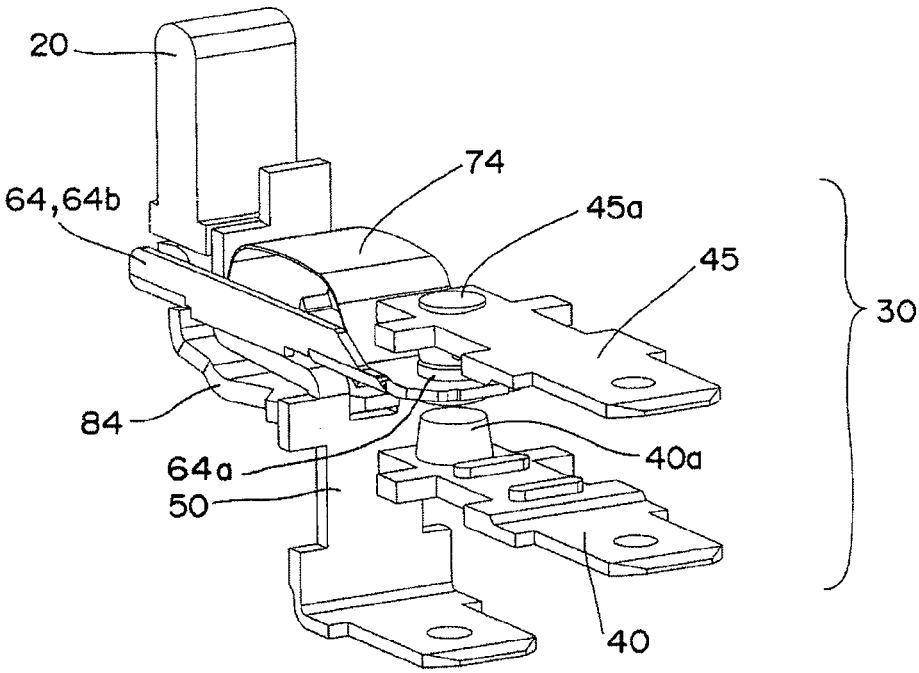
FIGS. 28A and 28B are perspective views showing a contact mechanism of the switch shown in FIGS. 25A, 25B, and 25C.
Figure 28B:
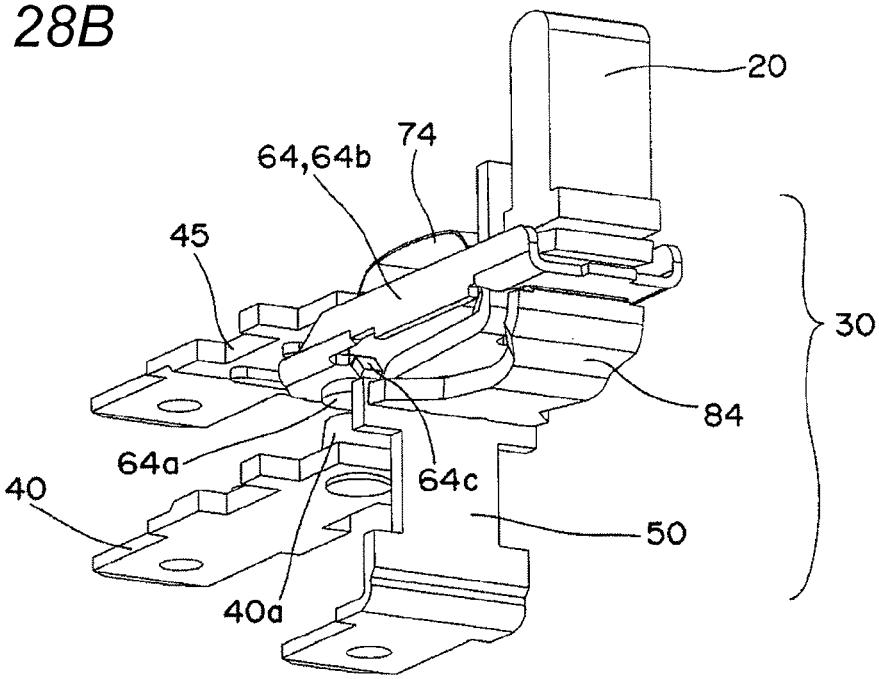

First, as shown in FIG. 26, the lock portion 84*a* of the operation piece 84 is locked to the lock receiving portion 54*a* arranged at the corner of the common terminal 50 from the lower side, and the inner side edge of the movable contact piece 60 is locked to the lock receiving portion 84*c* of the operation piece 84. Furthermore, one end 74*a* of the plate spring 74 is locked to the lock nail portions 64*c*, 64*c* of the movable contact piece 60 and one end 74*b* of the plate spring 74 is locked to the lock receiving portion 54*b* arranged at the corner of the common terminal 50 (see FIGS. 28A and 28B). The common terminal 50 is then press fit to the slit 16*c* of the base 16 shown in FIG. 26 for positioning, and the always-opened fixed contact terminal 40 and the always-closed fixed contact terminal 45 are respectively press fit to the slits 16*d*, 16*e* for positioning. The movable contact 64*a* is thus positioned between the always-opened fixed contact 40*a* and the always-closed fixed contact 45*a*, and is biased to the upper side. The operating element 20 is then fitted into and positioned in the operation hole 16*a* of the base 16, and thereafter, the positioning bosses 17*a*, 17*b* of the cover 17 are press fit and integrated to the operation holes 16*f*, 16*g* of the base 16 to complete the assembly task.

The operation method of the switch according to the fourth embodiment will now be described.

Figure 29A:
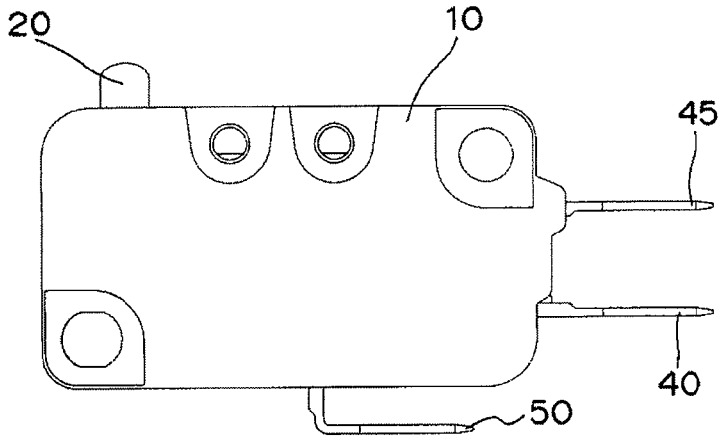
FIGS. 29A, 29B, and 29C are a front view describing the operation process, a cross-sectional view cut at a position of removing only the side wall on the front surface side of the housing, and a cross-sectional view cut at a position of vertically dividing the operating element in half.
Figure 29B:
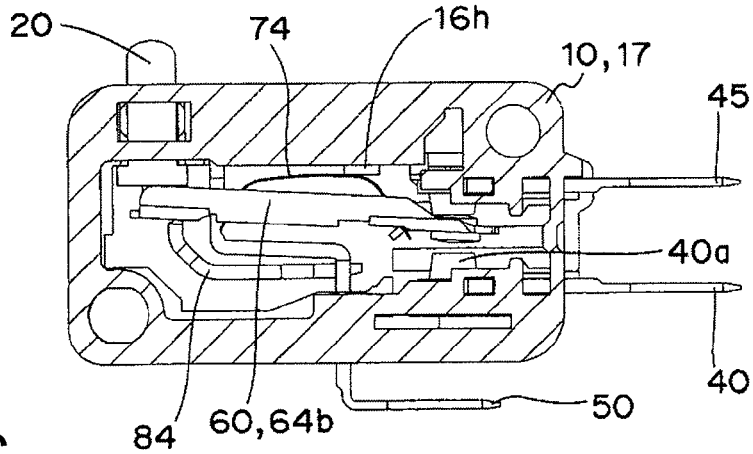
Figure 29C:
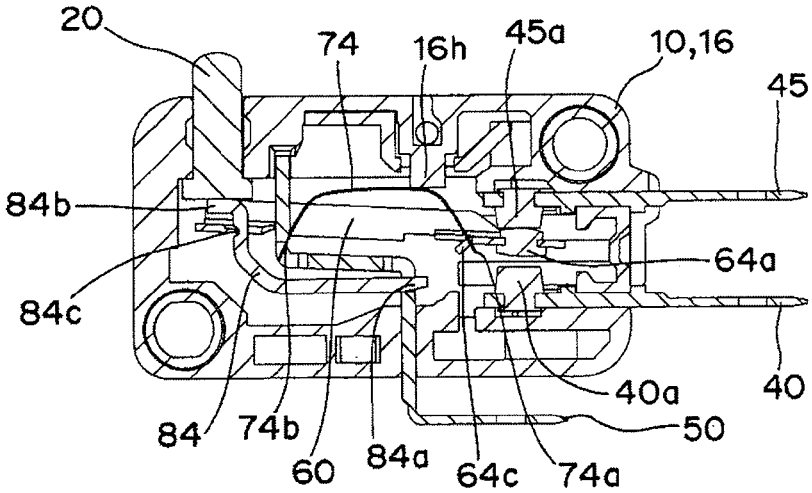

As shown in FIGS. 29A to 29C, if the operating element 20 is in the no-load state, the movable contact 64*a* is brought into contact with the always-closed fixed contact 45*a* at a predetermined contact pressure by the spring force of the plate spring 74 assembled to the movable contact piece 60.

Figure 30A:
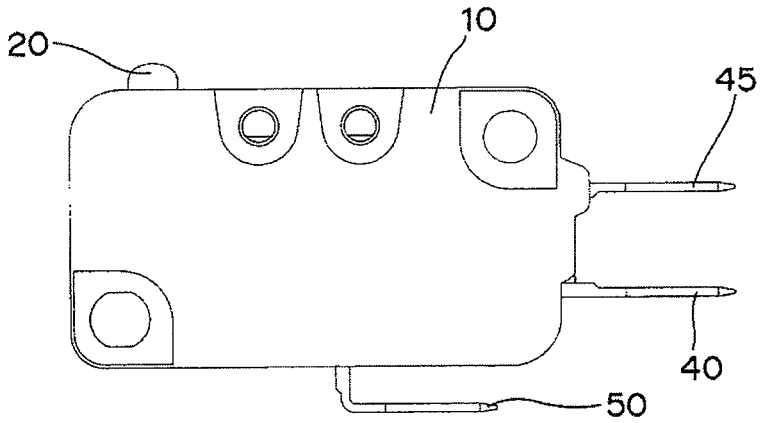
FIGS. 30A, 30B, and 30C are a front view describing the operation process, a cross-sectional view cut at a position of removing only the side wall on the front surface side of the housing, and a cross-sectional view cut at a position of vertically dividing the operating element in half.
Figure 30B:
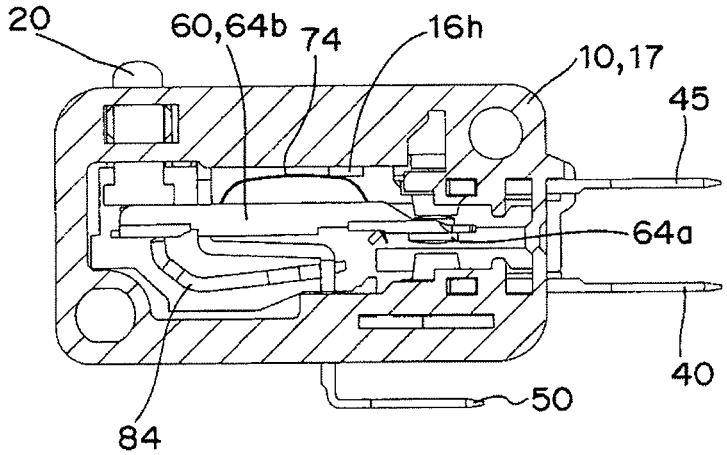
Figure 30C:
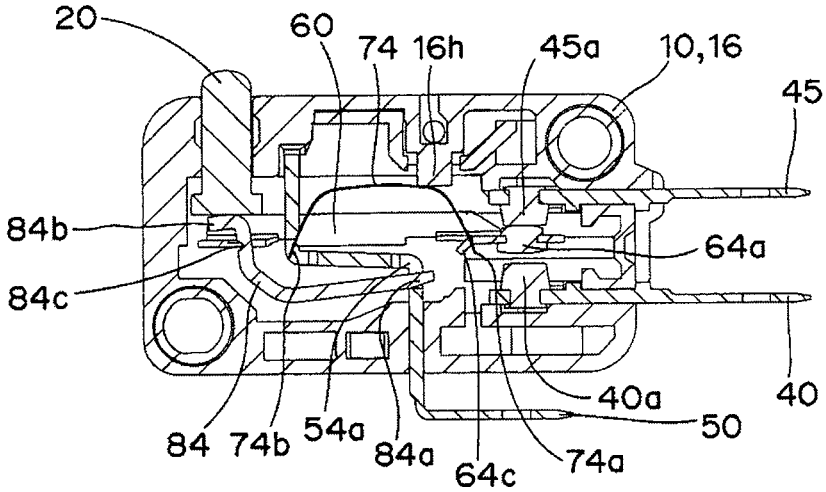
Figure 31A:
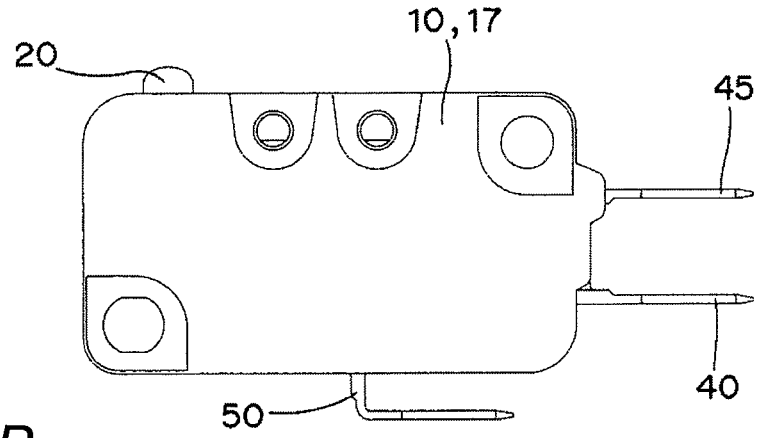
FIGS. 31A, 31B, and 31C are a front view describing the operation process, a cross-sectional view cut at a position of removing only the side wall on the front surface side of the housing, and a cross-sectional view cut at a position of vertically dividing the operating element in half.
Figure 31B:
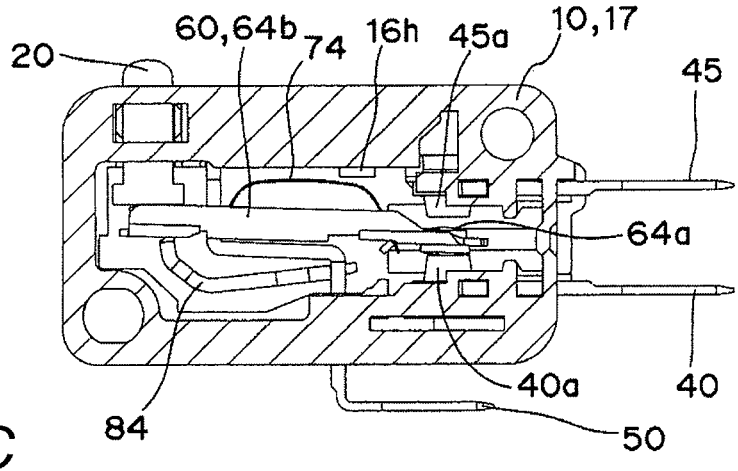
Figure 31C:
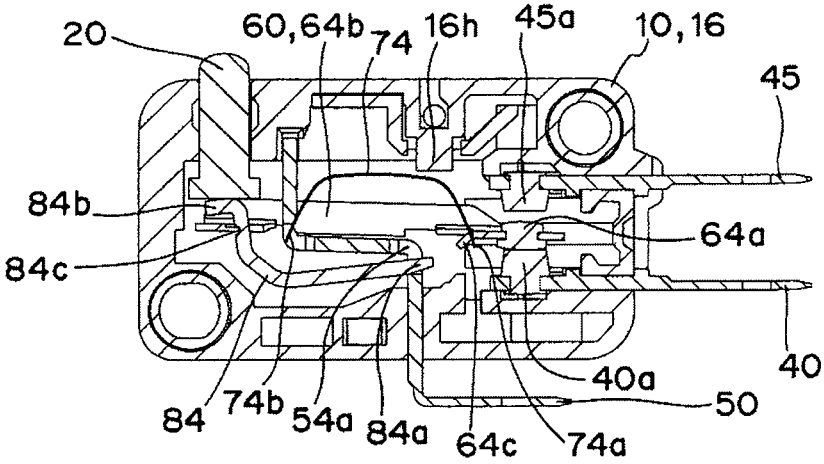

As shown in FIGS. 30A to 30C, when the operating element 20 is pushed down to push down the operation receiving portion 84*b* of the operation piece 84, the operation piece 84 turns with the lock portion 84*a* as the supporting point and the movable contact piece 60 lowers. When the reference line (not shown) connecting the lock receiving portion 84*c* of the operation piece 84 and the one end 74*a* of the plate spring 74 goes over the other end 74*b* of the plate spring 74, the movable contact piece 60 inverts with the lock receiving portion 84*c* of the operation piece 84 as the supporting point by the spring force of the plate spring 74 (FIGS. 31A to 31C). Therefore, the movable contact 64*a* switches from the always-closed fixed contact 45*a* to the always-opened fixed contact 40*a*.

Figure 32A:
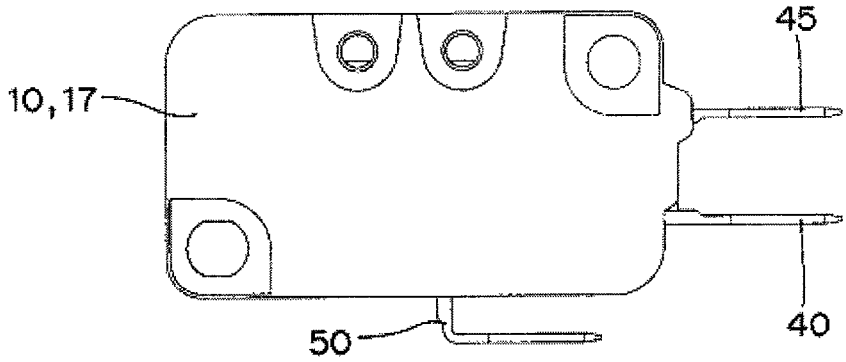
FIGS. 32A, 32B, and 32C are a front view describing the operation process, a cross-sectional view cut at a position of removing only the side wall on the front surface side of the housing, and a cross-sectional view cut at a position of vertically dividing the operating element in half.
Figure 32B:
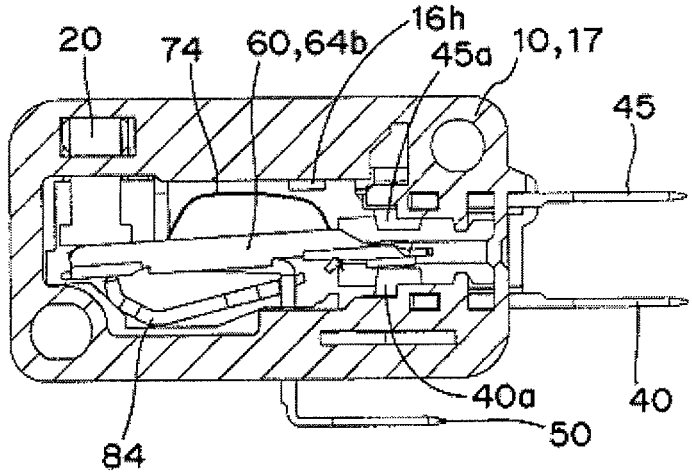
Figure 32C:
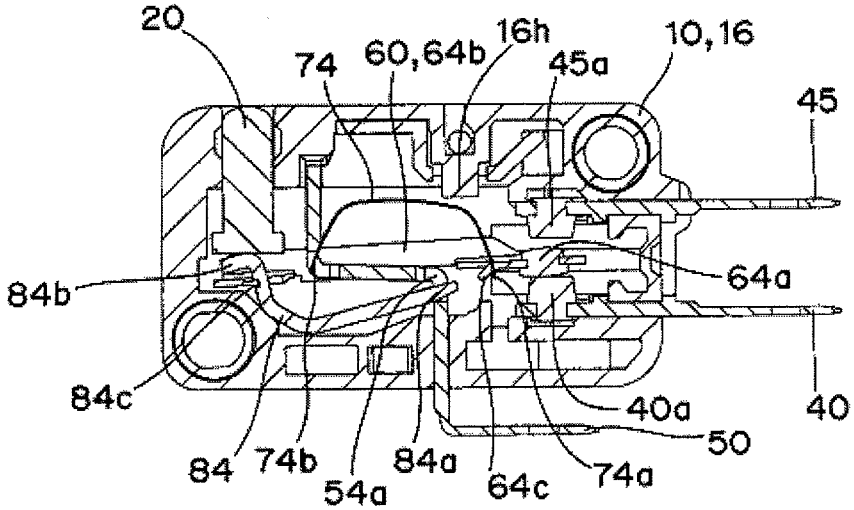

When the operating element 20 is further pushed in, the movable contact 64*a* is brought into contact with the always-opened fixed contact 40*a* at a predetermined contact pressure (FIGS. 32A to 32C).

When the load of the operating element 20 is released, the movable contact piece 60 is inverted by the spring force of the plate spring 74, and the movable contact 64*a* is switched from the always-opened fixed contact 40*a* to the always-closed fixed contact 45*a* to return to the original state.

The plate spring 74 elastically deforms and vibrates when the movable contact piece 60 turns, but the projection 16*h* arranged on the base 16 is brought into contact with the plate spring 74 thus shifting the timing of increasing the amplitude and preventing the resonance phenomenon.

Similarly, the resonance phenomenon can be prevented even if an impact force is applied from the outside since the plate spring 74 is brought into contact with the projection 16*h*.

EXAMPLE

The resonance experiment was conducted using samples of the switches according to the first and second embodiments as an example. The resonance experiment was similarly conducted under the same condition using a sample of a switch in which the tongue piece is not arranged as a comparative example. The measurement results are shown in the graph of FIG. 33.

Figure 33A:
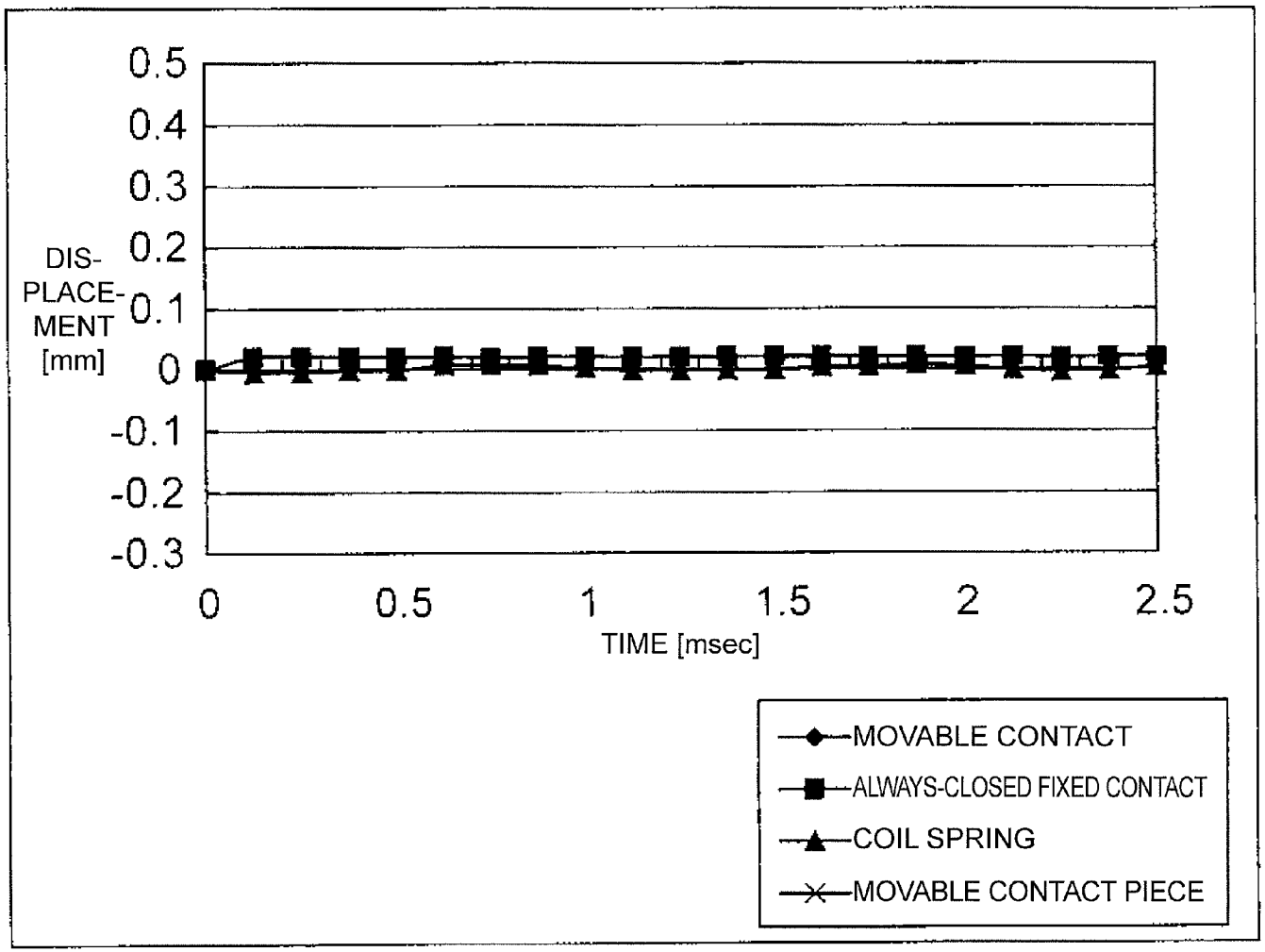
FIG. 33 is a graph showing the measurement result of the vibration experiment conducted on the first embodiment.

As shown in FIG. 33A, the resonance phenomenon did not occur in the coil spring in the example in which the tongue piece is arranged.

Figure 33B:
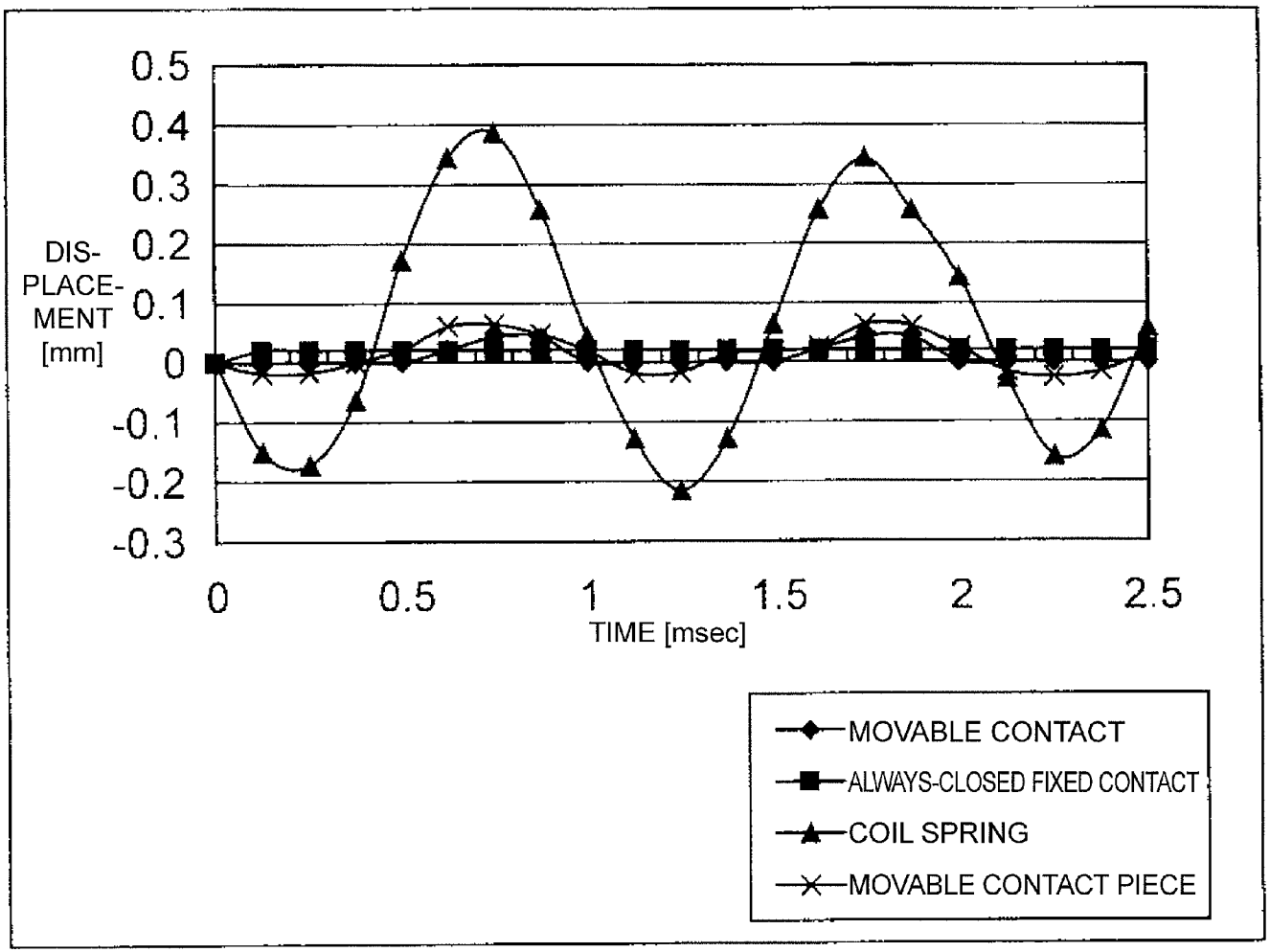

As apparent from FIG. 33B, the coil spring greatly vibrates and resonates in the comparative example in which the tongue piece is not arranged. Thus, it tends to easily break with increase in the number of stress oscillations and the lifespan also becomes shorter even if the stress amplitude width is within the elastic region. It is also recognized that the movable contact piece and the movable contact also vibrate with the resonance phenomenon of the coil spring.

According to the above experimental results, the false operation can be prevented and the lifespan can be extended by having the tongue piece inhibit the occurrence of the resonance phenomenon.

The switch according to the present invention is not limited to the above, and application may, obviously, be made on other micro-switches.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switch comprising:

a housing;

a contact mechanism having a movable contact piece disposed in the housing;

an operating element that operates the movable contact piece;

a spring member of the contact mechanism that operates the movable contact piece to open and close a contact; and a regulating means for suppressing vibration of the spring member arranged at a position contacting the spring member, wherein the regulating means is a tongue piece cutout from a terminal of the contact mechanism.

2. The switch according to claim 1, wherein the regulating means is arranged to be brought into contact with the spring member at time of resonance.

3. The switch according to claim 1, wherein the spring member is a coil member.

4. A switch comprising:

a housing;

a contact mechanism having a movable contact piece disposed in the housing;

an operating element that operates the movable contact piece;

a spring member of the contact mechanism that operates the movable contact piece to open and close a contact; and a regulating mechanism that suppresses vibration of the spring member arranged at a position contacting the spring member, wherein the regulating mechanism comprises a tongue piece cutout from a terminal of the contact mechanism.

5. The switch according to claim 4, wherein the regulating mechanism is arranged to be brought into contact with the spring member at time of resonance.

6. The switch according to claim 4, wherein the spring member is a coil member.

* * * * *